US010586483B2

(12) United States Patent
Park et al.

(10) Patent No.: US 10,586,483 B2
(45) Date of Patent: Mar. 10, 2020

(54) DISPLAY DEVICE, DRIVING DEVICE, AND METHOD FOR DRIVING THE DISPLAY DEVICE

(71) Applicant: Samsung Display Co., Ltd., Yongin-si (KR)

(72) Inventors: Jae Wan Park, Seoul (KR); Hyun-Uk Oh, Seongnam-si (KR); Keuntae Jung, Yongin-si (KR); Eunjung Oh, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 202 days.

(21) Appl. No.: 15/386,617

(22) Filed: Dec. 21, 2016

(65) Prior Publication Data

US 2018/0075797 A1 Mar. 15, 2018

(30) Foreign Application Priority Data

Sep. 9, 2016 (KR) ..... 10-2016-0116789

(51) Int. Cl.
*G09G 3/32* (2016.01)
*G09G 3/20* (2006.01)
(Continued)

(52) U.S. Cl.
CPC ..... *G09G 3/2092* (2013.01); *G09G 3/3233* (2013.01); *G09G 5/10* (2013.01);
(Continued)

(58) Field of Classification Search
CPC .. G09G 3/02; G09G 3/20; G09G 3/32; G09G 3/36; G09G 3/2092; G09G 3/3208;
(Continued)

(56) References Cited

U.S. PATENT DOCUMENTS 9,197,791 B2 11/2015 Lee et al.
2009/0085859 A1* 4/2009 Song ..... G09G 3/3406 345/102

(Continued)

FOREIGN PATENT DOCUMENTS

CN 104809980 7/2015
KR 10-2014-0143697 12/2014

(Continued)

OTHER PUBLICATIONS

The Extended European Search Report dated Feb. 9, 2018, issued in European Patent Application No. 17179968.7.

(Continued)

*Primary Examiner* — Chanh D Nguyen
*Assistant Examiner* — Nguyen H Truong
(74) *Attorney, Agent, or Firm* — H.C. Park & Associates, PLC

(57) ABSTRACT

A display device, a driving device, and a method that eliminates or reduces an image defect in a curved area of a display area of a display device. A display device includes a display area including a first pixel, a second pixel disposed along a curved edge of the display area, and a third pixel not corresponding to the curved edge, and a processor configured to drive the first pixel to have a first brightness, drive the second pixel to have a second brightness that is brighter than the first brightness, and drive the third pixel to have a third brightness that is brighter than the second brightness.

21 Claims, 16 Drawing Sheets

(51) Int. Cl.
*G09G 3/3233* (2016.01)
*G09G 5/10* (2006.01)

(52) U.S. Cl.
CPC . *G09G 2300/04* (2013.01); *G09G 2300/0452* (2013.01); *G09G 2310/0232* (2013.01); *G09G 2320/0233* (2013.01); *G09G 2320/0242* (2013.01); *G09G 2320/0271* (2013.01); *G09G 2320/0646* (2013.01)

(58) Field of Classification Search
CPC .. G09G 3/2003; G09G 3/3258; G09G 3/2022; G09G 3/3283; G09G 5/00; G09G 5/10; H01L 27/12; G02B 27/0025; G02B 5/045; G02B 5/32; G02F 1/13357; G02F 1/133512; G02F 1/13439; G02F 1/134309
See application file for complete search history.

(56) References Cited

U.S. PATENT DOCUMENTS

2011/0051007 A1* 3/2011 Hosaka ..... G09G 3/2003 348/673
2012/0176350 A1* 7/2012 Kim ..... G09G 3/3233 345/204
2014/0071175 A1 3/2014 Yang et al.
2015/0015590 A1 1/2015 Jeong et al.
2015/0364116 A1* 12/2015 Kong ..... G09G 3/3291 345/205
2016/0190166 A1 6/2016 Kim et al.
2016/0291376 A1* 10/2016 Iwatsu ..... G02F 1/133512
2018/0308413 A1* 10/2018 Jin ..... G09G 3/3607

FOREIGN PATENT DOCUMENTS

KR 10-2015-0009117 1/2015
KR 10-2015-0025774 3/2015
KR 10-2015-0040649 4/2015
KR 10-2016-0051154 5/2016
KR 20160081793 7/2016

OTHER PUBLICATIONS

European Search Report dated Oct. 11, 2017, for European application No. 17179968.7.

* cited by examiner

DISPLAY DEVICE, DRIVING DEVICE, AND METHOD FOR DRIVING THE DISPLAY DEVICE

CROSS-REFERENCE TO RELATED APPLICATION

This application claims priority from and the benefit of Korean Patent Application No. 10-2016-0116789, filed on Sep. 9, 2016, which is hereby incorporated by reference for all purposes as if fully set forth herein.

BACKGROUND

Field

Exemplary embodiments relate to a display device, a driving device, and a method of driving the display device.

Discussion of the Background

Display devices have become icons of modern information consuming societies. Whether in the form of a cellular phone, consumer appliance, portable computer, television, or the like, aesthetic and ergonomic appeal is as much design considerations as display quality and overall performance. Moreover, consumer demand has been trending toward display devices with more screen real estate without necessarily increasing the size of the display device (e.g., Samsung® Galaxy Note 7, Samsung® Galaxy S7 edge, iPhone® 6S Plus, and Samsung® SURD TVs) because consumers can receive more visual information (e.g., news alerts or notifications), have a more immersive experience, or have more area for touch interaction with these display devices having a larger screen in similar sized housing. In other words, consumers prefer display devices having smaller bezels than display devices with larger bezels. Thus, curved display devices and display devices with curved edges are gaining traction to meet this consumer demand. However, display devices having curved areas also have visual defects perceptible to consumers when driving pixels to display certain images (e.g., white images). Therefore, there is a need to efficiently and effectively drive pixels in curved areas of these display devices to reduce or eliminate visual defects while simultaneously clearly displaying images having high resolution.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device having a display area with a curved display with minimal or non-perceptible image defects.

Exemplary embodiments also provide a driving device configured to reduce or eliminate an image defect in a display device having a display area with a curved area.

Exemplary embodiments also provide a method for driving a pixel in a curved area of a display area of a display device in order to reduce or eliminate an image defect.

Additional aspects will be set forth in the detailed description which follows, and, in part, will be apparent from the disclosure, or may be learned by practice of the inventive concept.

An exemplary embodiment discloses a display device. The display device includes a display area including a first pixel, a second pixel disposed along a curved edge of the display area, and a third pixel not corresponding to the curved edge, and a processor configured to drive the first pixel to have a first brightness, drive the second pixel to have a second brightness that is brighter than the first brightness, drive the third pixel to have a third brightness that is brighter than the second brightness.

An exemplary embodiment also discloses a method of displaying an image on a display device. The method includes sending, by a processor of the display device, instructions to a data driver to supply a pixel with a first voltage corresponding to a first grayscale value when the processor determines that the location information of the pixel does not correspond to a curved edge in a curved area of a display area of the display device, sending, by the processor, instructions to the data driver to supply the pixel with a second voltage corresponding to a second grayscale value that is less than the first grayscale value when the processor determines that the location information of the pixel corresponds to a step end of the curved edge, and sending, by the processor, instructions to the data driver to supply the pixel with a third voltage corresponding to a third grayscale value that is greater than the second grayscale value and less than the first grayscale value when the processor determines that the location information of the pixel does not correspond to the step end of the curved edge.

An exemplary embodiment discloses a driving device. The driving device includes a processor configured to drive a first pixel in a display area of a display device to have a first brightness and drive a second pixel in the display area to have a second brightness that is brighter than the first brightness. The first pixel and the second pixel are disposed in a straight line along a curved edge of the display area.

An exemplary embodiment discloses a display device. The display device includes a display area comprising a first pixel and a second pixel disposed in a straight line along a curved edge of the display area, and a third pixel not corresponding to the curved edge. The display device also includes a non-display area having a curved boundary corresponding of the curved edge of the display area. The non-display area includes a dummy pixel. The first pixel is disposed at a step end of the straight line and has a first brightness. The second pixel is disposed furthest from the step end and has a second brightness that is brighter than the first brightness. The third pixel has a third brightness that is brighter than the second brightness.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1A:
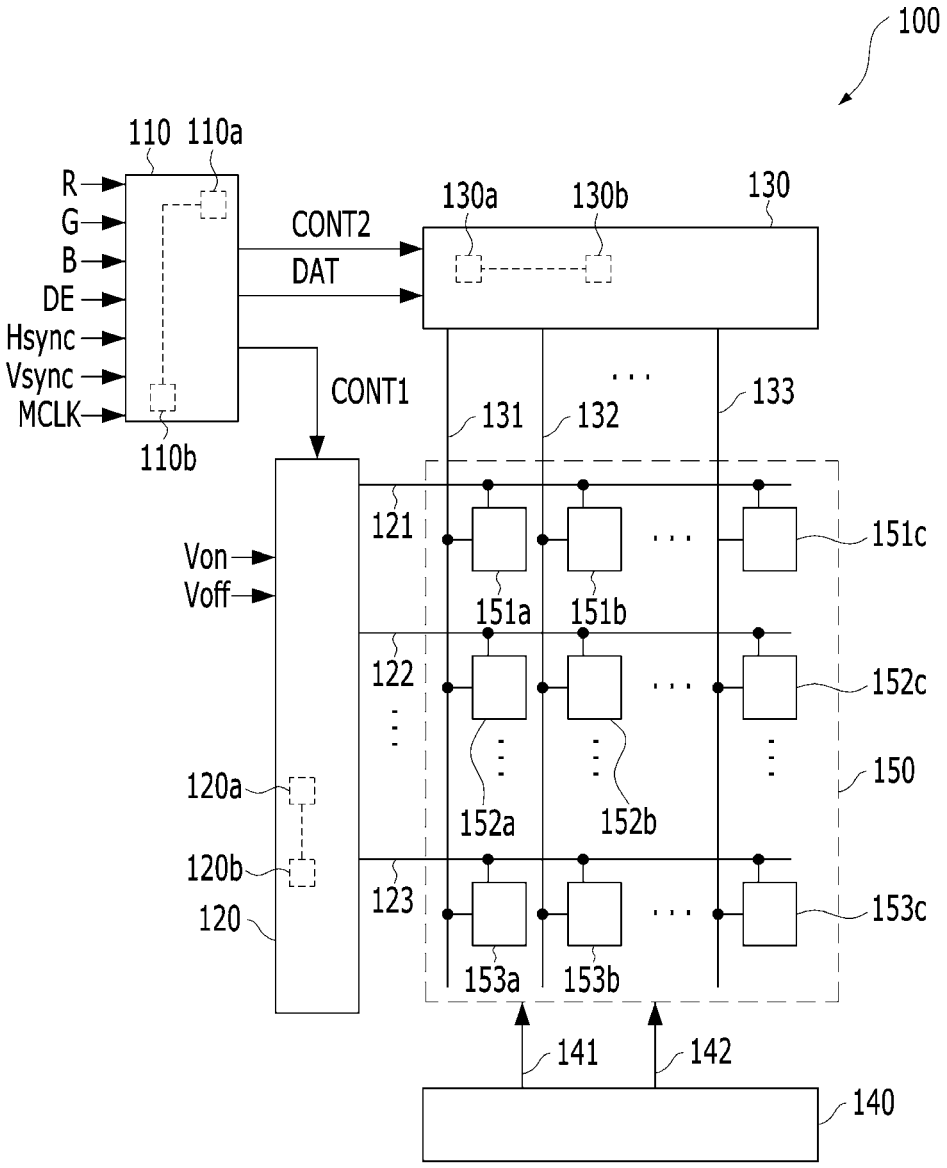
FIG. 1A is a block diagram of a display device according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of pixels, panels, regions, area, portions, etc., may be exaggerated for clarity and descriptive purposes. Also, like reference numerals denote like elements.

Unless otherwise specified, the illustrated exemplary embodiments are to be understood as providing exemplary features of varying detail of various exemplary embodiments. Therefore, unless otherwise specified, the features, blocks, components, elements, and/or aspects of the various illustrations may be otherwise combined, separated, interchanged, and/or rearranged without departing from the disclosed exemplary embodiments. Further, in the accompanying figures, the size and relative sizes of blocks, components, elements, etc., may be exaggerated for clarity and descriptive purposes.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, components, regions, portions, areas, and/or sections, these elements, components, regions, portions, areas, and/or sections should not be limited by these terms. These terms are used to distinguish one element, component, region, portion, area, and/or section from another element, component, region, portion, area, and/or section. Thus, a first element, component, region, and/or section discussed below could be termed a second element, component, region, portion, area, and/or section without departing from the teachings of the present disclosure.

Spatially relative terms, such as "beneath," "below," "lower," "above," "upper," "end," "inside," "left," "right," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

The term "pixel" is used herein to broadly refer to a sub-pixel or a unit pixel including two or more sub-pixels.

The term "RGBG Matrix" is used herein to refer to any arrangement of sub-pixels in a display device where the red and blue sub-pixels are arranged in the same column while the green sub-pixels are arranged in a column that is different from the red and blue sub-pixels. Additionally or alternatively, the red and blue sub-pixels are arranged in the same row while the green sub-pixels are arranged in a row that is different from the row of red and blue sub-pixels. Samsung Display, Co., Ltd. refers to this arrangement of sub-pixels as a PENTILE® arrangement.

The term "RBG Matrix" is used herein to refer to any arrangement of sub-pixels in a display device excluding the arrangement described above with respect to the term RGBG Matrix. For example, but by no means limiting, an RBG Matrix arrangement includes an arrangement where sub-pixels of the same color are arranged in separate columns and/or rows.

The terms "brightness" and "brightness level" are used interchangeably to refer to a relative luminance level or amount of a particular pixel.

Traditionally, display devices such as a liquid crystal display (LCD) and even an organic light emitting diode (OLED) display have polygonal shaped display areas. However, display devices having a polygonal shaped display area do not conform to ergonomic principles and limit the amount and particular location that an image can be displayed when considering the housing constraints of the display device (e.g., bezels). A display device having a non-polygonal shaped (i.e., closed shapes that have at least one curved segment) display area may have more screen real estate than it's polygonal restricted counterpart because the non-polygonal display area may provide visual information along a curved segment of a display device having a curved housing without cropping off the display area to fit a rigid polygonal shape.

Although non-polygonal display areas have advantages in that they can be used with display devices having a larger variety of housing shapes, these display devices have disadvantages as well. Non-polygonal display areas may have image defects along the curved edge segments of the display areas when displaying certain images. For example, if a white image is displayed along the entire non-polygonal display area, the curved edge segments of the display area may have green tinted defects in some portions of the curved edge, red tinted defects, blue tinted defects, or magenta (e.g., some combination of red and blue) tinted defects in other portions of the curved edge. Other color defects are also possible and these defects may be seen as lines or curves along the curved edge segment of the display area. As another example, a portion of an image displayed along a curved edge of these display devices may appear jagged or pixelated instead of having a smooth or gradual curve. Regardless of the exact image defect, the intended image and intended color along this curved edge is not visualized by a person looking at the non-polygonal display area. Accordingly, in order to reduce or eliminate for these image defects, display devices, a driving device, and a method of the driving the display device are described below with respect to various exemplary embodiments.

FIG. 1A is a block diagram of a display device according to an exemplary embodiment.

Referring to FIG. 1A, the display device 100 may include a signal controller 110, a scan driver 120, a data driver 130, a power supply 140, and a display 150. For convenience, but by no means limiting, FIG. 1A illustrates the display 150 having a polygonal shape. However, the display 150 may include either a polygonal or non-polygonal shape. In addition or alternatively, the display 150 may include a non-polygonal display area. For example, the display 150 may include a polygonal shaped display 150 having a display area that includes a curved edge. Moreover, the display 150 may be an OLED display. As another example, the display 150 may include a non-polygonal shaped display having a display area that includes a curved edge.

The display device 100 may be used in any device used to display information. For example, the display device 100 may be used in a mobile device (e.g., a tablet, a laptop computer, a smart phone, a smart watch, smart glasses, or any type of Virtual Reality (VR) display equipment). As another example, the display device 100 may be used in a desktop computer, a computer monitor, a television, or an electronic billboard.

The signal controller 110 may include a processor 110*a* and a memory 110*b* that is in communication with the processor 110*a*. The processor 110*a* of the signal controller 110 may receive an input image signal (RGB) (e.g., video signals) provided by an external device and an input control signal for controlling the input image signal (RGB). Alternatively, another component of the signal controller 110 may receive the input image signal (RGB), which may be stored in memory 110*b* and retrieved by the processor 110*a* when requested. The input image signal (RGB) may include luminance information for each pixel 151 and the luminance information may have a predetermined number (e.g., 1024=210, 256=28, or 64=26) of grayscale values. The input control signal may include a vertical synchronization signal (Vsync), a horizontal synchronization signal (Hsync), a main clock signal (MCLK), and a data enable signal (DE).

The processor 110*a* may generate a scan control signal (CONT1), a data control signal (CONT2), and an image data signal (DAT) based on the input image signal (RGB) and the input control signal and according to operational conditions of the display 150 and the data driver 130. In particular, the processor 110*a* may detect a first input image signal and a second input image signal for transmission to a first pixel and a second pixel that is disposed at a curved edge of the display 150 in the input image signal (RGB). Alternatively, one input image signal may have image information for more than one pixel.

The processor 110*a* may replace the first and second input image signals with corrected first and second input image signals having respective grayscales values that are less than the respective grayscales values associated with the uncorrected first and second input image signals. Based on the corrected first and second input image signals, the processor 110*a* may generate an image data signal (DAT) that includes information associated with the corrected first and second input image signals as well as information associated with other corrected and non-corrected input image signals for other pixels. The processor 110*a* may receive location information for a particular pixel from a particular input image signal (e.g., the first or second input image signal) or from information that is stored in memory 110*b* and retrieved to match the received image signal. Alternatively or additionally, the processor 110*a* may receive the location information for a particular pixel from any other source (e.g., the data driver 130 or scan driver 120). The processor 110*a* may determine which pixel should receive a particular input image signal (corrected or uncorrected) based on the input control signal, the input image signal (RGB), and the location information for the pixel. For example, the processor 110*a* may determine which pixel should receive a particular sub-set of image information embedded in the input image signal based on pixel location information or from information stored in memory 110*b* of the signal controller.

The processor 110*a* may send the scan control signal (CONT1) to the scan driver 120 based on the input image signal (RGB) and at least one of the image control signal and the pixel location information. The processor 110*a* may send the data control signal (CONT2) and the image data signal (DAT) to the data driver 130.

The display 150 may include a plurality of scan lines 121, 122, and 123, a plurality of data lines 131, 132, and 133, and a plurality of pixels 151*a*, 151*b*, 151*c*, 152*a*, 152*b*, 152*c*, 153*a*, 153*b*, and 153*c* connected to a plurality of signal lines (i.e., a plurality of scan lines 121, 122, and 123 and a plurality of data lines 131, 132, and 133). The plurality of pixels 151*a*, 151*b*, 151*c*, 152*a*, 152*b*, 152*c*, 153*a*, 153*b*, and 153*c* may be disposed in a matrix (e.g., an RGBG Matrix or an RBG Matrix). The plurality of scan lines 121, 122, and 123 may extend in a first direction (e.g., a row) and may be substantially parallel with each other. The plurality of data lines 131, 132, and 133 may extend in a second direction (e.g., a column) that is substantial perpendicular to the first direction. In addition, the plurality of data lines 131, 132, and 133 may be substantially parallel with each other. Although three scan lines 121, 122, 123, three data lines 131, 132, 133, and nine pixels 151*a*, 151*b*, 151*c*, 152*a*, 152*b*, 152*c*, 153*a*, 153*b*, and 153*c* are illustrated in FIG. 1A, exemplary embodiments are not limited to these numbers and more scan lines, data lines, and pixels are intended as illustrated by the vertical and horizontal ellipses. Three scan lines, three data lines, and nine pixels are illustrated in order to simplify FIG. 1A.

The scan driver 120 may include a processor 120*a* and a memory 120*b* in communication with the processor 120*a*. The processor 120*a* may control the application of a scan signal, a combination of a gate-on voltage (Von) and a gate-off voltage (Voff) to the plurality of scan lines 121, 122, and 123 according to the scan control signal (CONT1). The scan driver 120 may be connected to the plurality of scan lines 121, 122, and 123 and may apply the scan signal, the combination of a gate-on voltage (Von) and the gate-off voltage (Voff) to the plurality of scan lines 121, 122, and 123 according to the scan control signal (CONT1). The scan driver 120 may sequentially apply a scan signal with the gate on voltage (Von) to the plurality of scan lines 121, 122, and 123.

The data driver 130 may include a processor 130*a* and memory 130*b* in communication with the processor 130*a*. The processor 130*a* may control the application of a data voltage (Vdat) to the plurality of data lines 131, 132, and 133 in the display 150 according to the data control signal (CONT2) and the image data signal (DAT). Thus, the data driver 130 may be connected to the data the plurality of data lines 131, 132, and 133 and may apply the data voltage (Vdat) to the display 150 according to the data control signal (CONT2). The data driver 130 may select the data voltage (Vdat) according to the grayscale value of the image data signal (DAT). When the scan driver 120 sequentially applies the scan signal with the gate on voltage (Von) to the plurality of scan lines 121, 122, and 123, the data driver 130 may apply the data voltage (Vdat) for the pixel 151 on the horizontal line that corresponds to the scan line to which the gate on voltage (Von) is applied to the plurality of data lines 131, 132, and 133. For example, when the scan driver 120 applies the scan signal with the gate on voltage (Von) to scan line 121, the data driver 130 may apply the data voltage (Vdat) for at least one pixel 151*a*, 151*b*, and 151*c*.

The power supply 140 may supply a first power source voltage 141 and a second power source voltage 142 to the display 150. The first power source voltage 141 may be positive voltage and the second power source voltage 142 may be negative voltage or vice versa.

The above-described driving devices 110, 120, 130, and 140 may be installed as at least one integrated circuit chip, a flexible printed circuit film, as a tape carrier package (TCP) on the display 150. The driving devices 110, 120, 130, and 140 may be installed on an additional printed circuit board (PCB) that is separate from the display 150 or on the display 150. The driving devices 110, 120, 130, and 140 may be installed together with the plurality of signal lines 121, 122, 123, 131, 132, and 133.

Figure 1B:
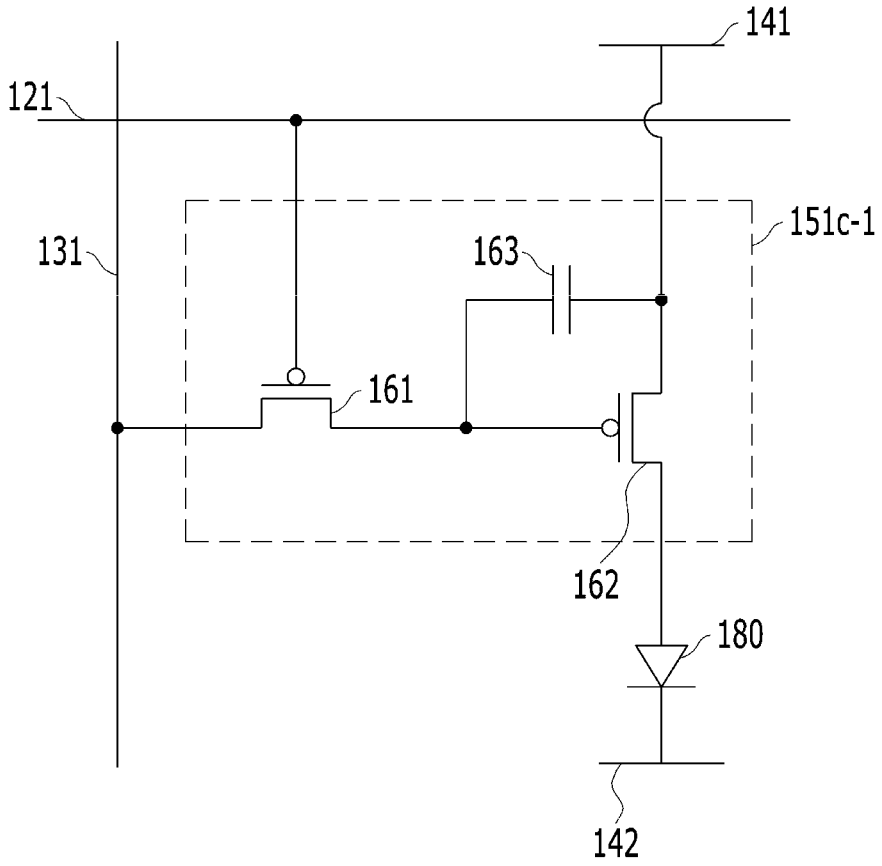
FIG. 1B is a circuit diagram of a pixel of FIG. 1A.

FIG. 1B is a circuit diagram of a pixel of FIG. 1A. The circuit diagram of FIG. 1B may be a pixel used the display device of FIG. 1A.

Referring to FIG. 1B, a pixel 151*c* of the display 150 may include an OLED 180 and a pixel circuit 151*c*-1 for controlling the OLED 180. The pixel circuit 151*c*-1 includes a switching transistor 161, a driving transistor 162, and a sustain capacitor 163.

The switching transistor 161 may include a gate electrode connected to a scan line 121, a first end connected to a data line 131, and a second end connected to a gate electrode of the driving transistor 162. The switching transistor 161 may be turned on by the scan signal of the gate on voltage (Von) that is applied to the scan line 121 to transmit the data voltage (Vdat) that is applied to the data line 131 to a gate electrode of the driving transistor 162.

The driving transistor 162 may include a gate electrode connected to the second end of the switching transistor 161, a first end for receiving the first power source voltage 141, and a second end connected to an anode of the OLED 180. The driving transistor 162 may control a current volume flowing to the OLED 180 from the first power source voltage 141 according to the data voltage (Vdat) that is applied to the gate electrode.

The sustain capacitor 163 may include a first end connected to the gate electrode of the driving transistor 162 and the second end of the switching transistor 161. The sustain capacitor may include a second end for receiving the first power source voltage 141. The sustain capacitor 163 may charge the data voltage (Vdat) that is applied to the gate electrode of the driving transistor 162 and may maintain the charging when the switching transistor 161 is turned off.

The OLED 180 may include an anode connected to the second end of the driving transistor 162 and a cathode for receiving the second power source voltage 142. The OLED 180 may emit light of one of the primary colors. For example, the OLED 180 may emit light having a red color, a green color, or a blue color. Desired colors may be displayed on display 150 by a spatial or temporal sum of the primary colors.

The switching transistor 161 and the driving transistor 162 may be p-channel field effect transistors. In this instance, the gate on voltage for turning on the switching transistor 161 and the driving transistor 162 is a logic low level voltage and the gate off voltage for turning off the same is a logic high level voltage.

Alternatively, at least one of the switching transistor 161 and the driving transistor 162 may be an n-channel field effect transistor. In this instance, the gate on voltage for turning on the n-channel field effect transistor is a logic high level voltage and the gate off voltage for turning the same off is a logic low level voltage.

The scan driver 120 may apply the gate on voltage (Von) to the scan line 121 according to the scan control signal (CONT1) to turn on the switching transistor 161. In this instance, the data driver 130 may apply the logic low level data voltage to the data line 131 according to the data control signal (CONT2). The sustain capacitor 163 may be charged by the data voltage from the data line 131 through the switching transistor 161. In addition, the data voltage from the data line 131 may turn on the driving transistor 162. A current corresponding to the data voltage flows to the OLED 180 through the turned-on driving transistor 162 from the first power source voltage 141. The OLED may emit light corresponding to the current that flows through the driving transistor 162.

The pixel circuit 151*c*-1 including two transistors and one capacitor has been described for convenience but is by no means limiting. The display device according to various exemplary embodiments described herein may include pixel circuits with any suitable structure that may vary from the pixel circuit 151*c*-1 shown in FIG. 1B.

In some exemplary embodiments, a plurality of sub-pixels each including an OLED for emitting light of one of red, green, and blue are disposed in an RGBG Matrix. In other exemplary embodiments a plurality of sub-pixels are disposed in other arrangements such as an RBG Matrix.

Figure 2A:
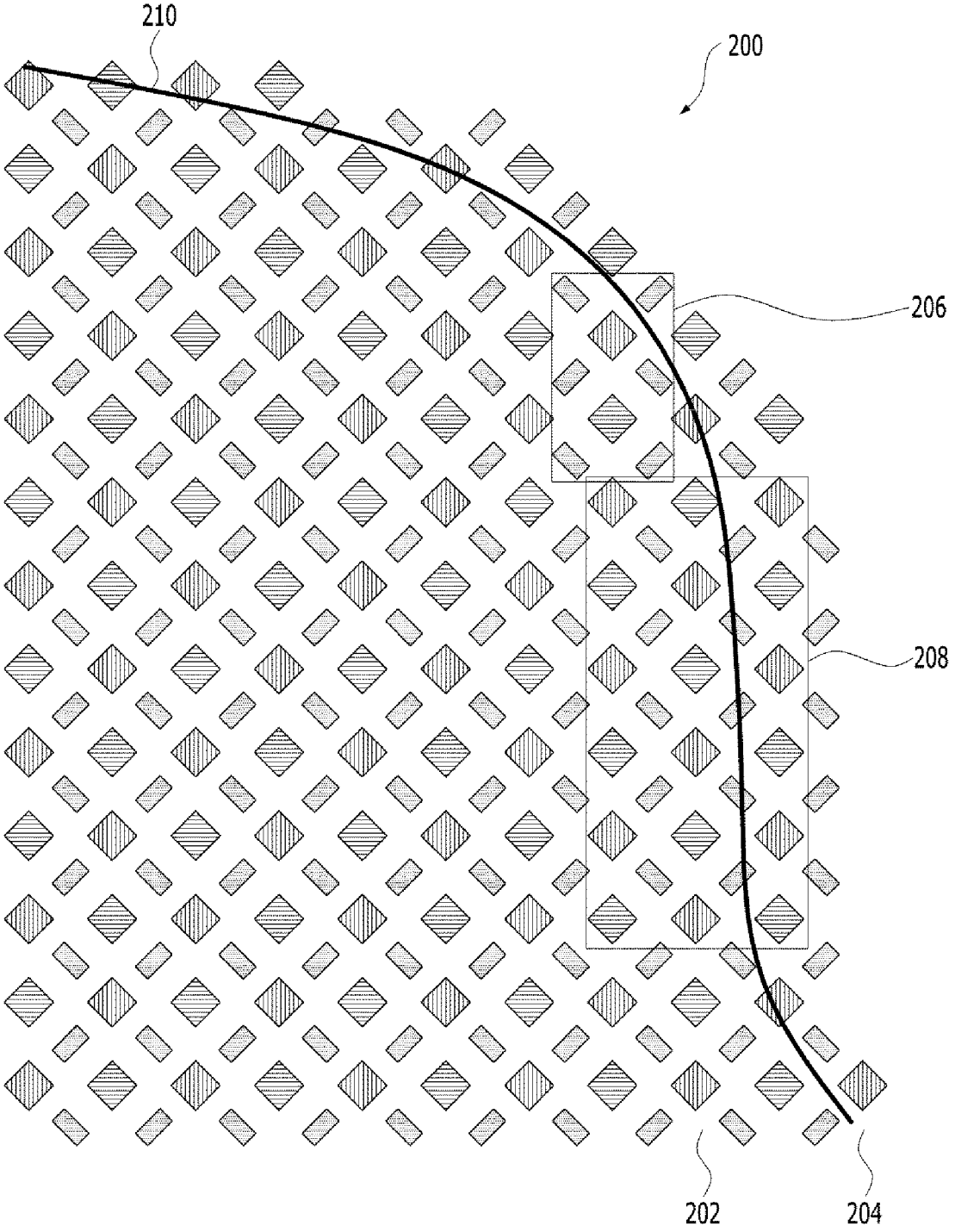
FIG. 2A illustrates a curved area having an RGBG Matrix according to an exemplary embodiment.
Figure 2B:
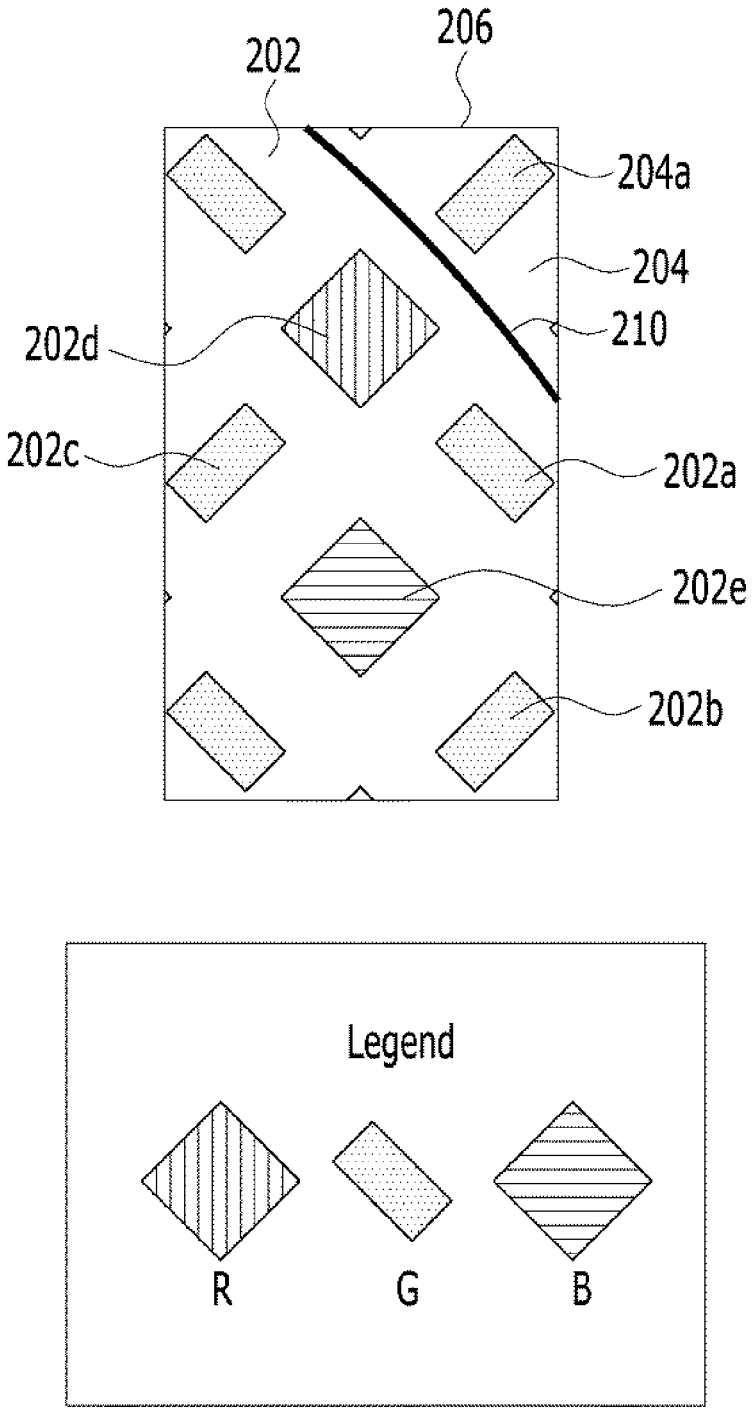
FIG. 2B illustrates a first enlarged portion of the curved area of FIG. 2A.
Figure 2C:
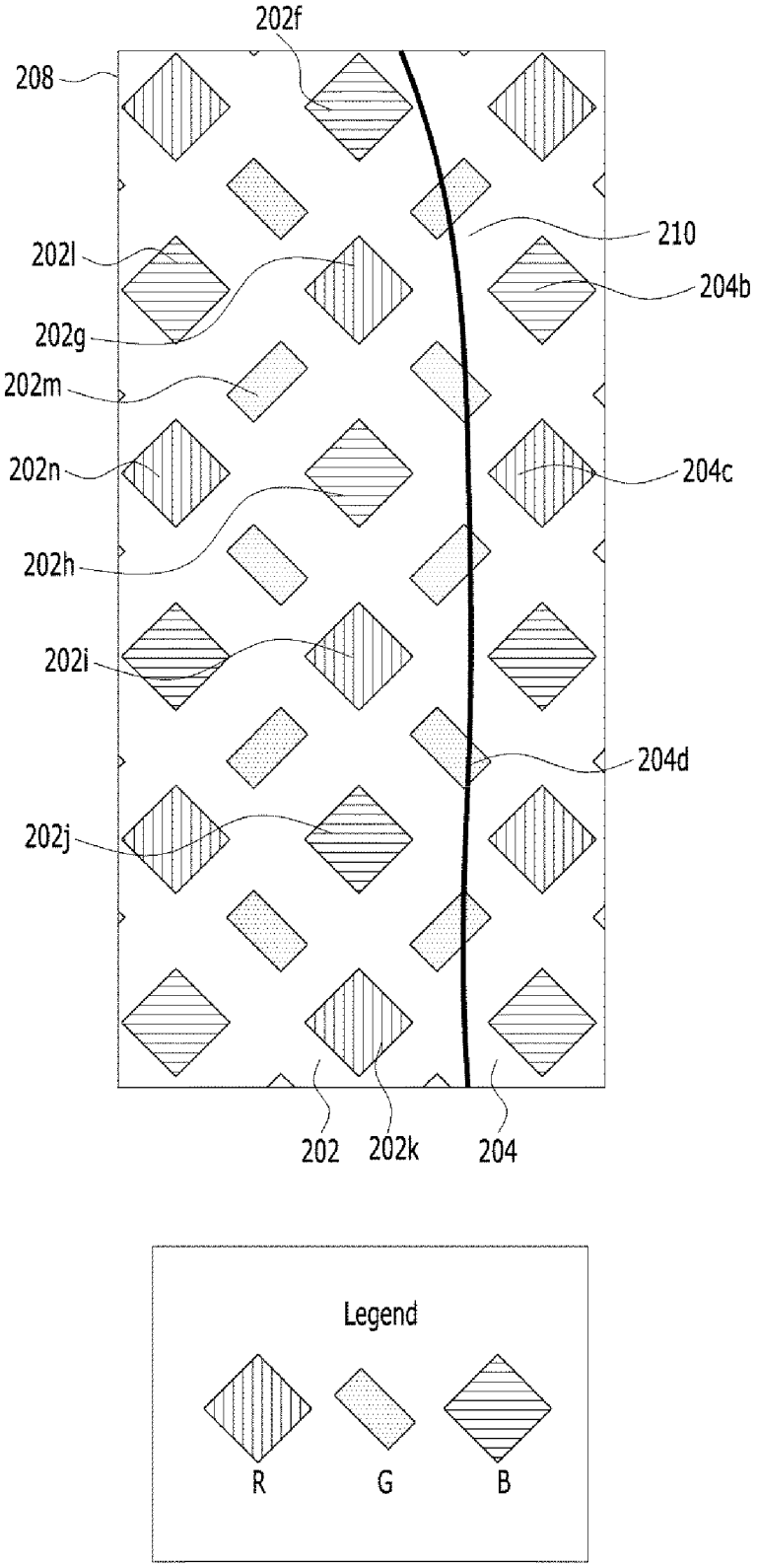
FIG. 2C illustrates a second enlarged portion of the curved area of FIG. 2A.

FIG. 2A illustrates a curved area having an RGBG Matrix according to an exemplary embodiment. FIG. 2B illustrates a first enlarged portion of the curved area of FIG. 2A. FIG. 2C illustrates a second enlarged portion of the curved area of FIG. 2A.

Referring to FIGS. 2A, 2B, and 2C, a display 150 of FIG. 1A may include a curved area 200. The curved area 200 may include a display area 202 and a non-display area 204 defined by a line 210 that includes a curved segment and that separates the display area 202 from the non-display area 204. Sub-pixels to the left of the line 210 (e.g., green sub-pixels 202*a*, 202*b*, 202*c*, and 202*m* and blue sub-pixels 2021, 202*f*, 202*h*, 202*j*, and 202*k*) are considered in the display area 202 while sub-pixels on the line 210 (e.g., green sub-pixel 204*d*) and to the right of the line 210 (e.g., green sub-pixel 204*a*, blue sub-pixel 204*b*, and red sub-pixel 204*c*) are considered in the non-display area 204. Sub-pixels in the non-display area may be dummy sub-pixels which may or may not emit light.

The edge of the display area 202 in the curved area 200 may include the curved segment and a plurality of columns of sub-pixels. Each of the plurality of columns may form a plurality of steps that define the curved segment. For example, a first column of sub-pixels may include green sub-pixels 202*a* and 202*b* as shown in the enlarged portion 206 of FIGS. 2A and 2B. As another example, a second column of sub-pixels may include blue sub-pixels 202*f*, 202*h*, and 202*j* and red sub-pixels 202*g*, 202*i*, and 202*k* as shown in the enlarged portion 208 of FIGS. 2A and 2C. The first column of sub-pixels 202*a* and 202*b* form a first step and the second column of sub-pixels 202*f*, 202*g*, 202*h*, 202*i*, 202*j*, and 202*k* form a second step that is lower than the first step in a plan view of an exemplary embodiment. Green sub-pixel 202*a* is considered at the step end of the first column and blue sub-pixel 202*f* is considered at the step end of the second column of an exemplary embodiment.

However, exemplary embodiments are not limited to displays 150 having columns of subpixels located at the curved edge of the display area. Exemplary embodiments include displays 150 having sub-pixels arranged in rows or oblique lines as long as two steps are made for defining a curved segment along the edge of the display area. For example, if the display area is rotated approximately 90°, the columns of sub-pixels may be considered rows of sub-pixels. Similarly, if the display area is rotated approximately 1° to 89°, the columns of sub-pixels may be considered sub-pixels arranged in oblique lines.

As shown in FIG. 2A, the edge of the display area 202 of the curved area 200 of FIG. 2A illustrates at least two distinct curved segments. However, exemplary embodiments are not limited to two distinct curved segments for an edge of the display area 202. Instead, the curved area 200 may include one curved segment at an edge of the display area 202 or any number of curved segments combined with a straight line segment.

Referring to FIGS. 2A, 2B, and 2C, the red sub-pixels (e.g., red sub-pixels 202*d*, 202*g*, 202*i*, 202*k*, 202*n*, and 204*c*) and blue sub-pixels (e.g., blue sub-pixels 202*e*, 202*f*, 202*h*, 202*j*, 2021, and 204*b*) are illustrated as having a rhombus shape in FIGS. 2A, 2B, and 2C in plan view. Additionally, the green sub-pixels (e.g., green sub-pixels 202*a*, 202*b*, 202*c*, 202*m*, and 204*d*) are illustrated as having a rectangular shape in plan view and a surface area that is less than the surface area of each red or blue sub-pixel in plan view. Although, exemplary embodiments include sub-pixels having the approximate shapes and relative sizes illustrated, exemplary embodiments are not limited to sub-pixels having these relative shapes and sizes. For example, at least one of the red sub-pixel, blue sub-pixel, and green sub-pixel may have any polygonal shape (e.g., a hexagonal shape, an octagonal shape, or rectangular shape) or non-polygonal shape (e.g., a circular or any other closed shape having a curved segment). As another example, a green sub-pixel may have a shape and size that is the same as or different than at least one of the red sub-pixel and a blue sub-pixel. As another example, a red sub-pixel may have a shape and size that is the same as or different than at least one of a blue sub-pixel and a green sub-pixel. As a further example, at least one of a red sub-pixel, a blue sub-pixel, and a green sub-pixel located in the display area 202 of the display 150 may have a different size or shape than a corresponding red sub-pixel, blue sub-pixel, and green sub-pixel located in the non-display area 204.

For convenience and clarity, only the actions of the signal controller 110 are described below. However, actions described as being performed by the signal controller 110 such as dimming or driving various sub-pixels or unit pixels may be performed solely by a processor 110*a* of the signal controller 110, a processor 120*a* of the scan driver 120, a processor 130*a* of the data driver 130 or some combination of processors 110*a*, 120*a*, or 130*a*.

The signal controller 110 may dim the sub-pixels located in a column at the curved edge according to a gradient where a first sub-pixel at a step end of the column has the lowest brightness and a second sub-pixel furthest from the step end located in the same column and within the defined step (e.g., not adjacent to a step end of an adjacent column) has the highest brightness. The brightness levels of any sub-pixels in the same column between the first sub-pixel at the step end and the sub-pixel at the opposite end of the step end is at a brightness that is between the highest brightness and lowest brightness for that column. The highest brightness and lowest brightness for the column may be less than the lowest brightness of a sub-pixel (e.g., one of sub-pixels 202*c*, 202*d*, 202*e*, 2021, 202*m*, or 202*n*) disposed inside the curved edge.

Figure 2D:
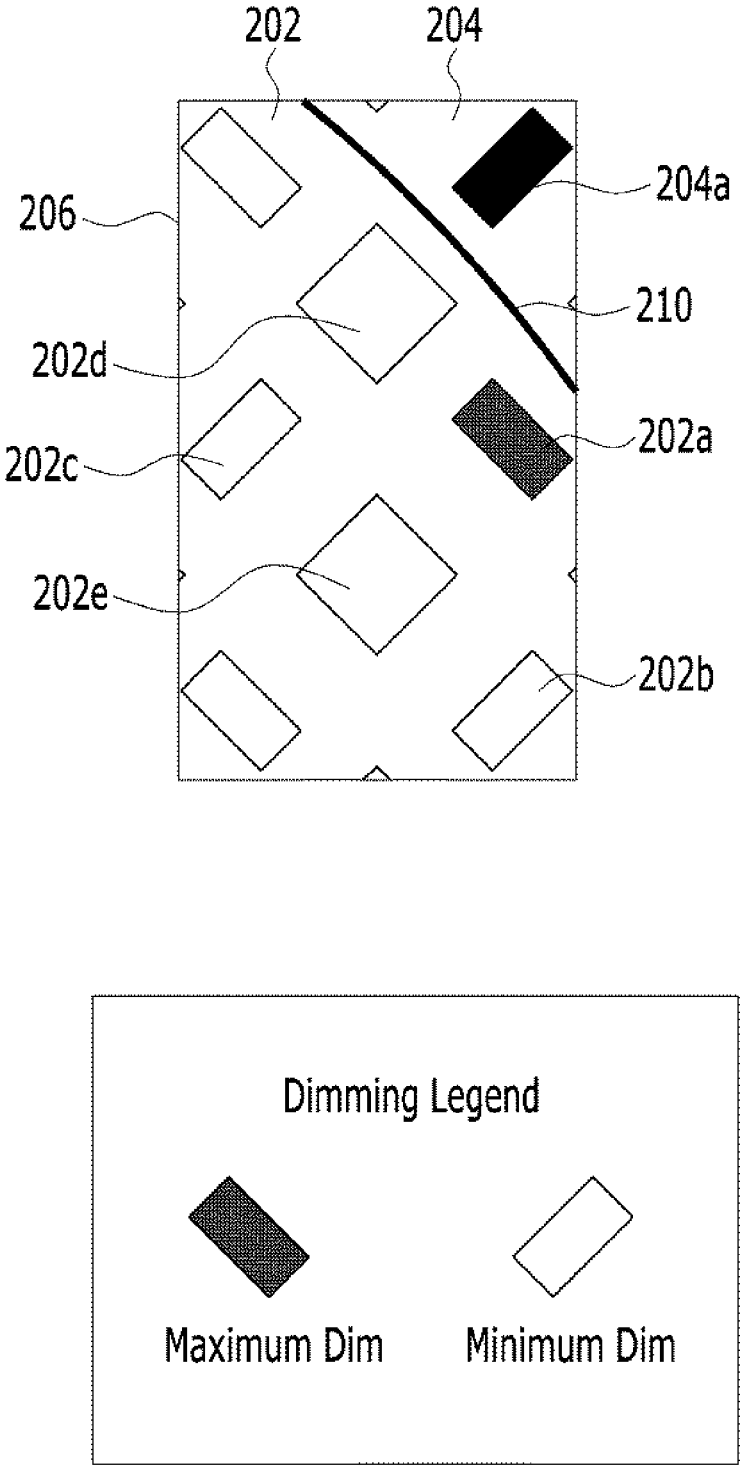
FIG. 2D illustrates the first enlarged portion of FIG. 2B in a drive state according to an exemplary embodiment.

FIG. 2D illustrates the first enlarged portion of FIG. 2B in a drive state according to an exemplary embodiment.

Referring to FIGS. 1A, 2A, and 2D, the signal controller 110 may dim green sub-pixels 202*a* and 202*b* to a brightness (i.e., a luminance) that is less than the brightness of a green sub-pixel 202*c* located inside the curved edge. Similarly, the signal controller 110 may dim the green sub-pixels 202*a* and 202*b* to a brightness that is less than the brightness of at least one of a red sub-pixel 202*d* and a blue sub-pixel 202*e*. The signal controller 110 may dim a first green sub-pixel 202*a* located at the step end of the first column along the curved edge to a first brightness. Additionally, the signal controller 110 may dim a second green sub-pixel 202*b* at a location furthest from the step end in the first column to a second brightness that is brighter than the first brightness. Furthermore, the signal controller 110 may drive a third green sub-pixel 202*c* to a fourth brightness that is brighter than the second brightness. In other words, the signal controller 110 may drive the green sub-pixels located in the first column to have luminance levels according to a gradient to eliminate an image defect (e.g., a green line that is perceptible to a user or a jagged edge) along a curved edge segment of the display area when displaying an image.

Figure 2E:
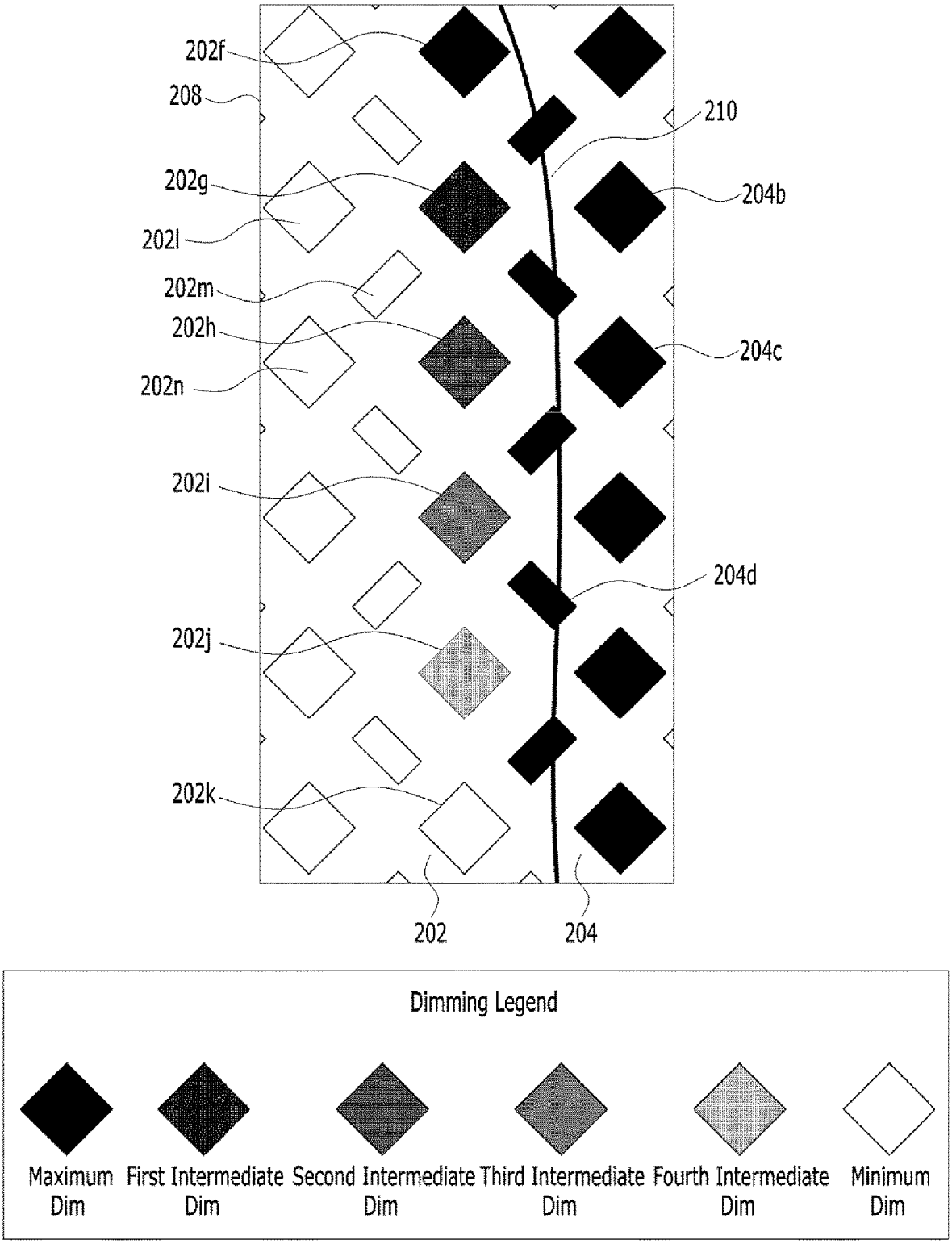
FIG. 2E illustrates the second enlarged portion of FIG. 2C in a drive state according to an exemplary embodiment.

FIG. 2E illustrates the second enlarged portion of FIG. 2C in a drive state according to an exemplary embodiment.

Referring to FIGS. 1A, 2B, and 2E, the signal controller 110 may dim the blue sub-pixels 202*f*, 202*h*, and 202*j* located in the second column of the curved edge to various brightness levels that are less than a brightness level of at least one of a blue sub-pixel 202*l*, a red subpixel 202*n*, and a green sub-pixel 202*m* located inside the curved edge. Similarly, the signal controller 110 may dim the red sub-pixels 202*g*, 202*i*, and 202*k* located in the second column to various brightness levels that are less than a brightness level of at least one of a blue sub-pixel 202*l*, a red subpixel 202*n*, and a green sub-pixel 202*m* located inside the curved edge.

Specifically, the signal controller 110 may dim a first sub-pixel (e.g., blue sub-pixel 202*f*) to have a first brightness and a second sub-pixel (e.g., red sub-pixel 202*k*) to have a second brightness that is brighter than the first brightness. The signal controller 110 may drive a third sub-pixel (e.g., blue sub-pixel 202*l*, red sub-pixel 202*n*, or green sub-pixel 202*m*) to have a third brightness that is brighter than the second brightness. The signal controller 110 may also dim a fourth sub-pixel (e.g., red sub-pixel 202*g*, red sub-pixel 202*i*, blue sub-pixel 202*h*, or blue sub-pixel 202*j*) to have a fourth brightness that is brighter than the first brightness but less than the second brightness. The signal controller 110 may dim additional sub-pixels located within a step of a curved edge so that the column of sub-pixels within the step are dimmed according to a gradient. By dimming the sub-pixels located within a step of a curved edge according to a gradient, the signal controller 110 may eliminate or reduce an image defect (e.g., a red tinted line, a blue tinted line, a magenta tinted line, or jagged edge).

Moreover, in an exemplary embodiment, the signal controller 110 may turn on (with or without dimming) or turn off a dummy sub-pixel (e.g., green sub-pixel 204*a*, blue sub-pixel 204*b*, or red sub-pixel 204*c*) to display a particular color or to correct a color to display a particular image on the display 150. For example, the signal controller 110 may turn on and dim the green sub-pixel 204*a* if the image to be display has a green edge.

Figure 3:
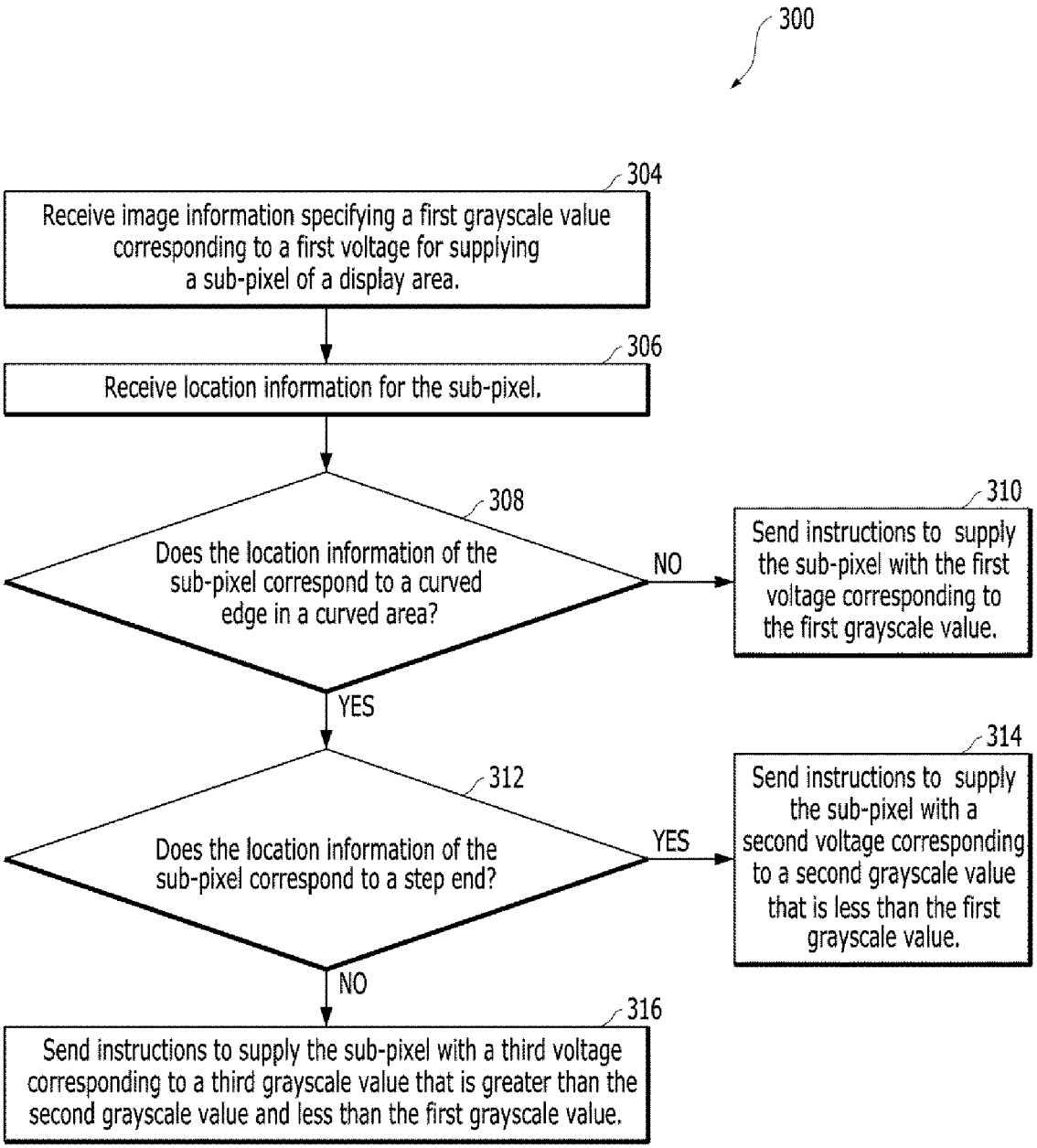
FIG. 3 is a process flow diagram illustrating an exemplary embodiment method for a signal controller to dim a sub-pixel of a curved area based on a gradient.

FIG. 3 is a process flow diagram illustrating an exemplary embodiment method for a signal controller to dim a sub-pixel of a curved area based on a gradient.

Referring to FIG. 3, an exemplary embodiment method 300 may be implemented on a signal controller 110 to eliminate or reduce an image defect that is perceptible to a user and found along a curved edge of a display area 202 of display device 100.

The method 300 may be initialized when a user enables the display device 100 (e.g., presses a button, toggles a remote, or a signal from any other input device is received) and the signal controller 110 receives power. Alternatively, the display device 100 may initialize without the involvement of a user.

After being initialized, in block 304, the signal controller 110 may receive image information specifying a first grayscale value corresponding to a first voltage for supplying a sub-pixel of a display area of a display device. For example, the signal controller 110 may receive image information from a storage device or other external device such as a wireless receiver, or a set top box (e.g., a traditional cable box, a Samsung® Smart Cable Box, an Apple TV®, a Google Chromecast® Device, or an Amazon Fire® TV Device). The image information may correspond to a grayscale value which is interpreted later by the data driver 130 to provide the intended sub-pixel with the appropriate voltage (e.g., a first voltage if the sub-pixel corresponds to a sub-pixel located inside the curved edge).

In block 306, the signal controller 110 may receive location information for the sub-pixel. For example, the signal controller 110 may receive location information for a particular sub-pixel from information stored in internal memory 110*b*, the scan driver 120, the data driver 130, the image input signal (RGB), the input control signal, or any other signal received from an external source. The location information may be data information specifying the location of a particular sub-pixel. For example, the location information may refer to a location of particular pixel based on coordinates defined by the cross-sections of the plurality of scan lines 121, 122, and 123 and the plurality of data lines 131, 132, and 133.

In determination block 308, the signal controller 110 may determine whether the received location information for the sub-pixel corresponds to a curved edge in a curved area 200 of the display area. For example, the signal controller may determine whether the location information for the image to be displayed corresponds to at least one of green sub-pixels 202*a* and 202*b* located at a curved edge of the display area or whether the location information corresponds a green sub-pixel (e.g., green sub-pixel 202*c*) located inside the curved edge of the display area of FIG. 2B.

When the signal controller 110 determines that the location information of the sub-pixel does not correspond to the curved edge in the curved area 200 of the display area 202 (i.e., determination block 308="No"), the signal controller 110 sends instructions to the data driver 130 to supply the sub-pixel with the first voltage corresponding to the first grayscale value in block 310. For example, the signal controller 110 may determine that the location information of the sub-pixel for the image to be displayed corresponds to green sub-pixel 202*c* and may send instructions to the data driver 130 via a data control signal (CONT2) and/or an image data signal (DAT) to supply the green sub-pixel 202*c* with a voltage corresponding to a non-corrected grayscale as shown in FIG. 2D. The data driver 130, in conjunction with the scan driver 120, may control the gates of the switching transistor 161 and the driving transistor 162 so that the appropriate voltage and current is supplied to the OLED 180 of the green sub-pixel 202*c* from the first power source voltage 141 and the second power source voltage 142.

When the signal controller 110 determines that the location information of the sub-pixel corresponds to the curved edge in the curved area 200 of the display area 202 (i.e., determination block 308="Yes"), the signal controller 110 may move to determination block 312. For example, the signal controller 110 may determine that the location information of the sub-pixel for the image to be displayed corresponds to green sub-pixel 202*a* or green sub-pixel 202*b* located in a first column of the curved edge of a curved area 200 of the display area 202.

In determination block 312, the signal controller 110 may determine whether the received location information for the sub-pixel corresponds to a step end within the curved edge. For example, the signal controller 110 may determine whether the location information of the sub-pixel for the image to be displayed corresponds to the green sub-pixel 202*a* located at the step end or whether the location information corresponds to the green sub-pixel 202*b* located at an end that is opposite the step end of the sub-pixels at the curved edge.

When the signal controller 110 determines that the location information of the sub-pixel corresponds to the step end (i.e., determination block 312="Yes"), the signal controller 110 may send instructions to the data driver 130 to supply the sub-pixel with a second voltage corresponding to a second grayscale value that is less than the first grayscale value in block 314. For example, the signal controller 110 may determine that the location information of the sub-pixel for the image to be displayed corresponds to green sub-pixel 202*a* and may send instructions to the data driver 130 via a data control signal (CONT2) and/or an image data signal (DAT) to supply the green sub-pixel 202*a* with a voltage corresponding to a corrected grayscale (e.g., a second grayscale value) as shown in FIG. 2D. The data driver 130, in conjunction with the scan driver 120, may control the gates of the switching transistor 161 and the driving transistor 162 so that the appropriate voltage and current is supplied to the OLED 180 of the green sub-pixel 202*a* from the first power source voltage 141 and the second power source voltage 142. In other words, the second voltage supplied to the green sub-pixel 202*a* is less than the first voltage supplied to the green sub-pixel 202*c*.

When the signal controller 110 determines that the location information of the sub-pixel does not correspond to the step end (i.e., determination block 312="No"), the signal controller 110 may send instructions to the data driver 130 to supply the sub-pixel with a third voltage corresponding to a third grayscale value that is greater than the second grayscale value and less than the first grayscale value in block 316. For example, the signal controller 110 may determine that the location information of the sub-pixel for the image to be displayed corresponds to green sub-pixel 202*b* and may send instructions to the data driver 130 via a data control signal (CONT2) and/or an image data signal (DAT) to supply the green sub-pixel 202*b* with a voltage corresponding to a corrected grayscale (e.g., a third grayscale value) as shown in FIG. 2D. The data driver 130, in conjunction with the scan driver 120, may control the gates of the switching transistor 161 and the driving transistor 162 so that the appropriate voltage and current is supplied to the OLED 180 of the green sub-pixel 202*b* from the first power source voltage 141 and the second power source voltage 142. In other words, the third voltage supplied to the green sub-pixel 202*b* is greater than the second voltage supplied to the green sub-pixel 202*a* but less than the first voltage supplied to the green sub-pixel 202*c*.

Using method 300 described above, the signal controller 110 may drive the green sub-pixels 202*a* and 202*b* so they are dimmed according to a gradient to eliminate or reduce an image defect in a display device having a display area with a curved area 200 as shown in FIG. 2D. Although, method 300 is described with respect to green sub-pixels, the method may be applied to any type of sub-pixels (e.g., blue or red sub-pixels) located at a curved edge of a display area.

Figure 4:
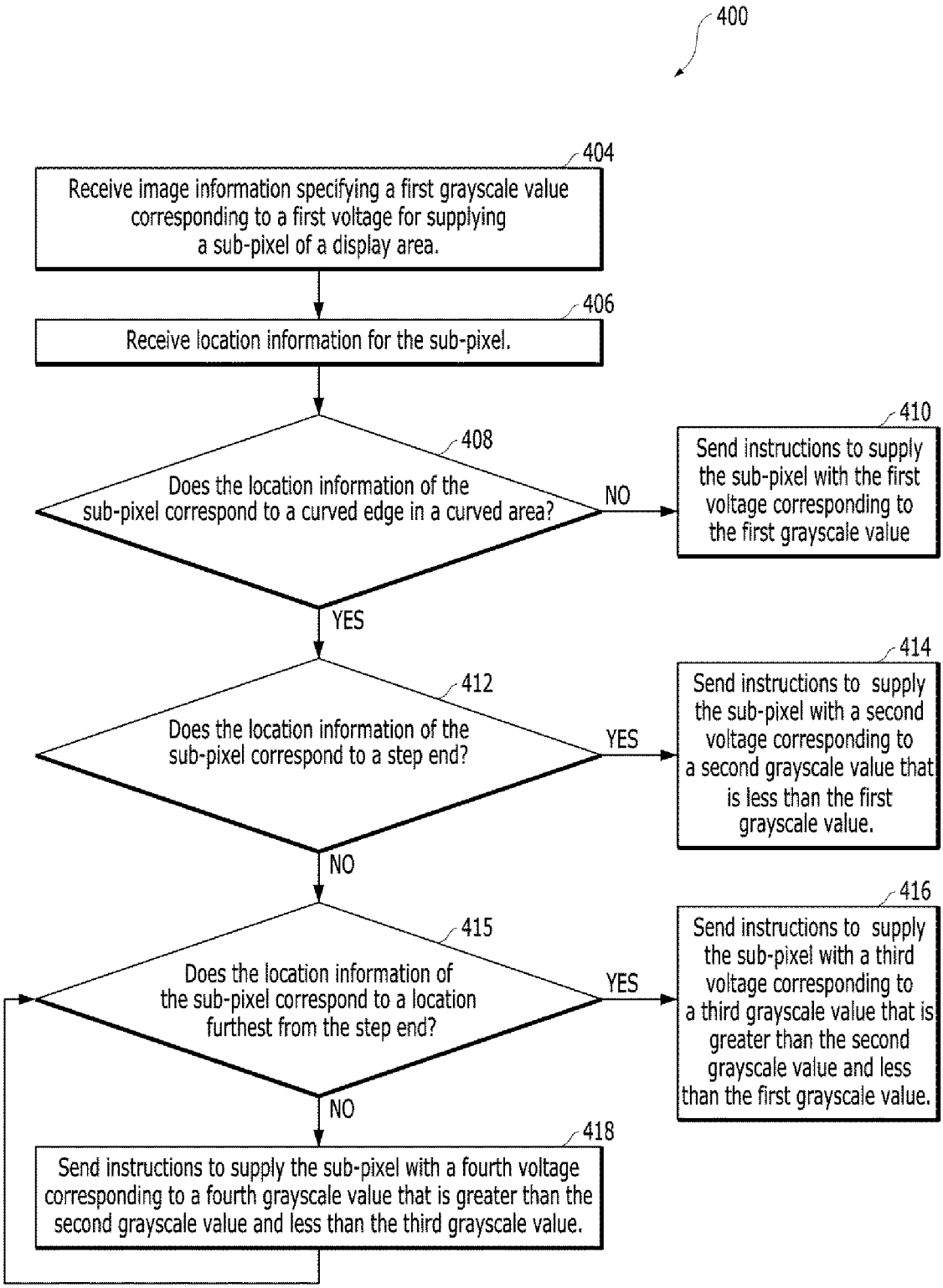
FIG. 4 is a process flow diagram illustrating an exemplary embodiment method for a signal controller to recognize a specific location of a sub-pixel of a curved area and dim the sub-pixel based on a gradient.

FIG. 4 is a process flow diagram illustrating an exemplary embodiment method for a signal controller to recognize a specific location of a sub-pixel of a curved area and dim the sub-pixel based on a gradient.

Referring to FIG. 4, an exemplary embodiment method 400 that may be implemented on a signal controller 110 to eliminate or reduce an image defect that is perceptible to a user and found along a curved edge of a display area 202 of display device 100. Method 400 is similar to method 300 of FIG. 3, except that method 400 of FIG. 4 includes additional steps 415 and 418 which do not have analogous steps in method 300. For brevity and clarity, only the major differences between these methods will be described.

The method 400 refers to a method for driving a sub-pixel disposed in a column of three or more sub-pixels located at a step of a curved edge. The method 400 dims a third sub-pixel, located between a first sub-pixel at the step end and a second sub-pixel at the opposite end of the step end, to a third brightness that is between the highest brightness (i.e., the brightness of the first sub-pixel) and the lowest brightness (i.e., the brightness of the second sub-pixel) for that column.

Blocks 404 and 406 of method 400 are similar to blocks 304 and 306 of method 300 and are omitted for brevity. Please refer to the analogous descriptions of blocks 304 and 306 with respect to FIG. 3.

In determination block 408, the signal controller 110 may determine whether the received location information for the sub-pixel corresponds to a curved edge in a curved area 200 of the display area. For example, the signal controller may determine whether the location information for the image to be displayed corresponds to at least one of a blue sub-pixel (e.g., one of blue sub-pixels 202*f*, 202*h*, and 202*j*) and a red-sub-pixel (e.g., one of red sub-pixels 202*g*, 202*i*, and 202*k*) located at a curved edge of the display area or whether the location information corresponds to at least one of a red sub-pixel (e.g., red sub-pixel 202*d*) and a blue sub-pixel (e.g., blue sub-pixel 202*e*) located inside the curved edge of the display area of FIG. 2C.

When the signal controller 110 determines that the location information of the sub-pixel does not correspond to the curved edge in the curved area 200 of the display area 202 (i.e., determination block 408="No"), the signal controller 110 sends instructions to the data driver 130 to supply the sub-pixel with the first voltage corresponding to the first grayscale value in block 410. For example, the signal controller 110 may determine that the location information of the sub-pixel for the image to be displayed corresponds to blue sub-pixel 202*l* or red sub-pixel 202*n* and may send instructions to the data driver 130 via a data control signal (CONT2) and/or an image data signal (DAT) to supply the blue sub-pixel 202*l* or red sub-pixel 202*n* green sub-pixel 202*c* with a voltage corresponding to a non-corrected grayscale as shown in FIG. 2E. The data driver 130, in conjunction with the scan driver 120, may control the gates of the switching transistor 161 and the driving transistor 162 so that the appropriate voltage and current is supplied to the OLED 180 of the green sub-pixel 202*c* from the first power source voltage 141 and the second power source voltage 142.

When the signal controller 110 determines that the location information of the sub-pixel corresponds to the curved edge in the curved area 200 of the display area 202 (i.e., determination block 408="Yes"), the signal controller 110 may move to determination block 412. For example, the signal controller 110 may determine that the location information of the sub-pixel for the image to be displayed corresponds to at least one a blue sub-pixel (e.g., one of blue sub-pixels 202*f*, 202*h*, and 202*j*) or a red sub-pixel (e.g., one of red sub-pixels 202*g*, 202*i*, and 202*k*) located in a second column of the edge of a curved area 200 of the display area 202.

In determination block 412, the signal controller 110 may determine whether the received location information for the sub-pixel corresponds to a step end within the curved edge.

For example, the signal controller 110 may determine whether the location information of the sub-pixel for the image to be displayed corresponds to the blue sub-pixel 202*f* located at the step end and at the curved edge or whether the location information corresponds to at least one of sub-pixels 202*g*, 202*h*, 202*i*, 202*j*, or 202*k* located merely at the curved edge.

When the signal controller 110 determines that the location information of the sub-pixel corresponds to the step end (i.e., determination block 412="Yes"), the signal controller 110 may send instructions to the data driver 130 to supply the sub-pixel with a second voltage corresponding to a second grayscale value that is less than the first grayscale value in block 414. For example, the signal controller 110 may determine that the location information of the sub-pixel for the image to be displayed corresponds to blue sub-pixel 202*f* and may send instructions to the data driver 130 via a data control signal (CONT2) and/or an image data signal (DAT) to supply the blue sub-pixel 202*f* with a voltage corresponding to a corrected grayscale (e.g., a second grayscale value) as shown in FIG. 2E. The data driver 130, in conjunction with the scan driver 120, may control the gates of the switching transistor 161 and the driving transistor 162 so that the appropriate voltage and current is supplied to the OLED 180 of the blue sub-pixel 202*f* from the first power source voltage 141 and the second power source voltage 142. In other words, the second voltage supplied to the blue sub-pixel 202*f* is less than the first voltage supplied to the blue sub-pixel 202*l* or red sub-pixel 202*n*.

When the signal controller 110 determines that the location information of the sub-pixel does not correspond to the step end (i.e., determination block 412="No"), the signal controller 110 may move to determination block 415. For example, the signal controller 110 may determine that location information of the sub-pixel for the image to be displayed corresponds does not correspond to the blue sub-pixel 202*f* located at the step end.

In determination block 415, the signal controller 110 may determine whether the received location information for the sub-pixel corresponds to an end furthest from the step end. For example, the signal controller 110 may determine whether the location information of the sub-pixel for the image to be displayed corresponds to red sub-pixel 202*k* or whether it corresponds to a sub-pixel (e.g., one of sub-pixels 202*g*, 202*h*, 202*i*, or 202*j*) located between the red sub-pixel 202*k* located at an end opposite of the step end and the blue sub-pixel 202*f* located at the step end.

When the signal controller 110 determines that the location information of the sub-pixel corresponds to a location furthest from the step end (i.e., determination block 415="Yes"), the signal controller 110 may send instructions to the data driver 130 to supply the sub-pixel with a third voltage corresponding to a third grayscale value that is greater than the second grayscale value and less than the first grayscale value in block 416. For example, the signal controller 110 may determine that the location information of the sub-pixel for the image to be displayed corresponds to red sub-pixel 202*k* and may send instructions to the data driver 130 via a data control signal (CONT2) and/or an image data signal (DAT) to supply the red sub-pixel 202*k* with a voltage corresponding to a corrected grayscale (e.g., a third grayscale value) as shown in FIG. 2E. The data driver 130, in conjunction with the scan driver 120, may control the gates of the switching transistor 161 and the driving transistor 162 so that the appropriate voltage and current is supplied to the OLED 180 of the red sub-pixel 202*k* from the first power source voltage 141 and the second power source voltage 142. In other words, the third voltage supplied to the red sub-pixel 202*k* is greater than the second voltage supplied to the blue sub-pixel 202*f* but less than the first voltage supplied to the blue sub-pixel 202*l* or the red sub-pixel 202*n*.

When the signal controller 110 determines that the location information of the sub-pixel does not corresponds to a location furthest from the step end (i.e., determination block 415="No"), the signal controller 110 may send instructions to the data driver 130 to supply the sub-pixel with a fourth voltage corresponding to a fourth grayscale value that is greater than the second grayscale value and less than the third grayscale value as in block 418. For example, the signal controller 110 may determine that the location information of the sub-pixel for the image to be displayed corresponds to blue sub-pixel 202*j* and may send instructions to the data driver 130 via a data control signal (CONT2) and/or an image data signal (DAT) to supply the red sub-pixel 202*k* with a voltage corresponding to a corrected grayscale (e.g., a fourth grayscale value) as shown in FIG. 2E. The data driver 130, in conjunction with the scan driver 120, may control the gates of the switching transistor 161 and the driving transistor 162 so that the appropriate voltage and current is supplied to the OLED 180 of the blue sub-pixel 202*j* from the first power source voltage 141 and the second power source voltage 142. In other words, the fourth voltage supplied to the blue sub-pixel 202*j* is greater than the second voltage supplied to the blue sub-pixel 202*f* but less than the third voltage supplied to the red sub-pixel 202*k*.

Blocks 415 and 418 may be repeated based on the particular location of a sub-pixel relative to other sub-pixels in the column. The fourth voltage and fourth grayscale value may be any amount or level in order to create a gradient. For example, there may be many granular levels of fourth voltages and fourth grayscale values for each of the sub-pixels located between the step end and the end furtherest from the step end. For example, the second grayscale value may be at 10% of the first grayscale value for sub-pixel 202*f*, the third grayscale value may be at 90% of the first grayscale value for sub-pixel 202*k*, and the fourth grayscale value may be 25%, 40%, 60%, and 75% of the first grayscale value for respective intervening sub-pixels sub-pixel 202*g*, 202*n*, 202*i*, and 202*j*.

Using method 400 described above, the signal controller 110 may drive the blue sub-pixels 202*f*, 202*h*, and 202*j* as well as the red sub-pixels 202*g*, 202*i*, and 202*k* such that they are dimmed according to a gradient to eliminate or reduce image defect in a display device having a display area with a curved area 200 as shown in FIG. 2E. Although, method 400 is described with respect to blue and red sub-pixels, the method may be applied to any type of sub-pixels (e.g., green sub-pixels) located at a curved edge of a display area. Moreover, although the examples described in conjunction with method 400 above discuss driving and dimming only three sub-pixels at three different levels, it is envisioned and intended that any number of sub-pixel located in a column (e.g., six sub-pixels) at a curved edge to eliminate or reduce image defect in a display device having a display area with a curved area using the same or an analogous method.

Although, FIGS. 2A, 2B, 2C, 2D, 2E, 3, and 4 are described and illustrated using a display device having sub-pixels arranged in an RGBG Matrix, this is by no means limiting. The devices, method, and components may be used with respect to a display device having sub-pixels arranged in an RBG Matrix or any other sub-pixel arrangement. As will be described briefly below, similar methods and driving techniques may be used to dim entire unit pixels located at curved edge of a display area according to a gradient.

Figure 5A:
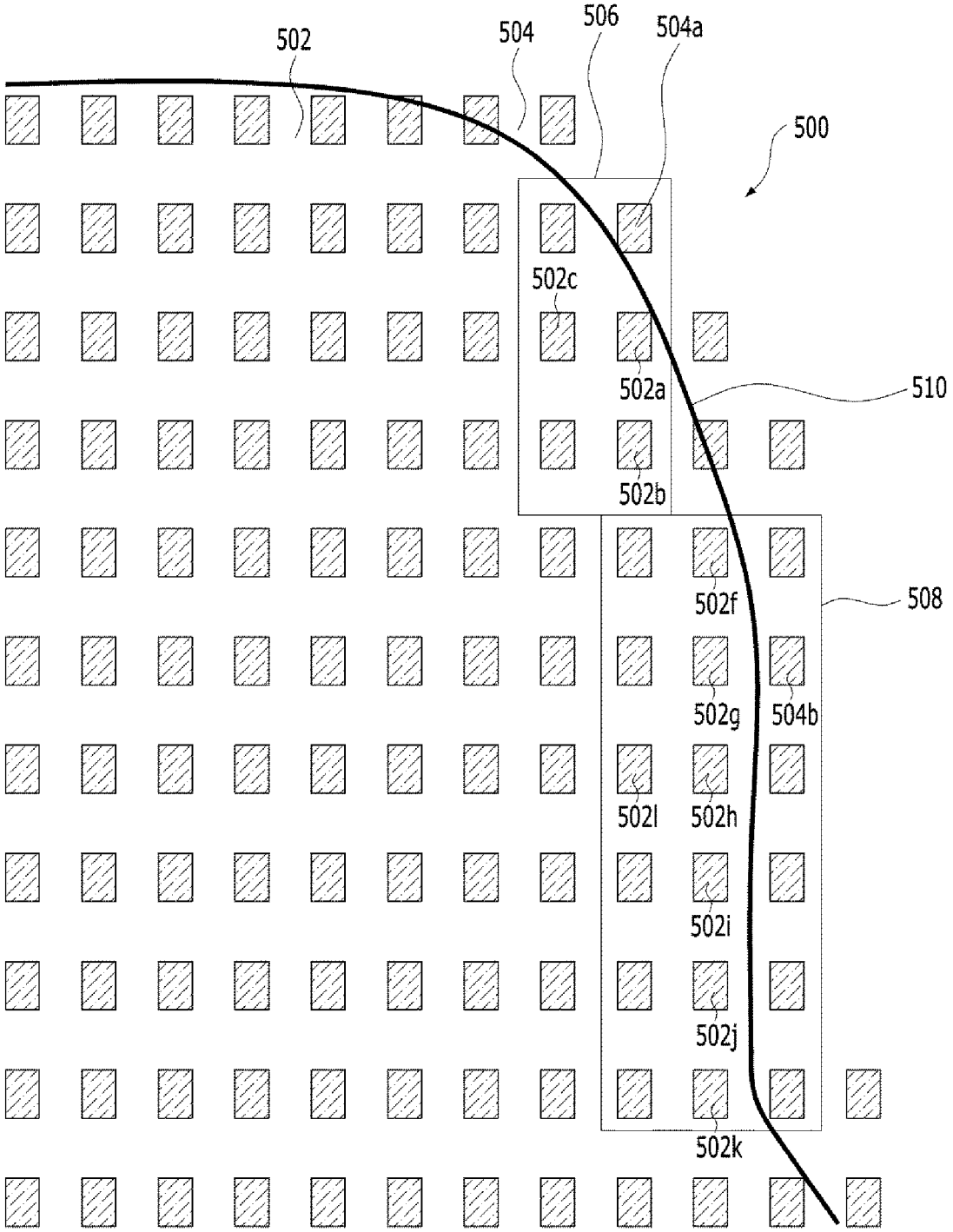
FIG. 5A illustrates a curved area of the display device of FIG. 1A according to an exemplary embodiment.
Figure 5B:
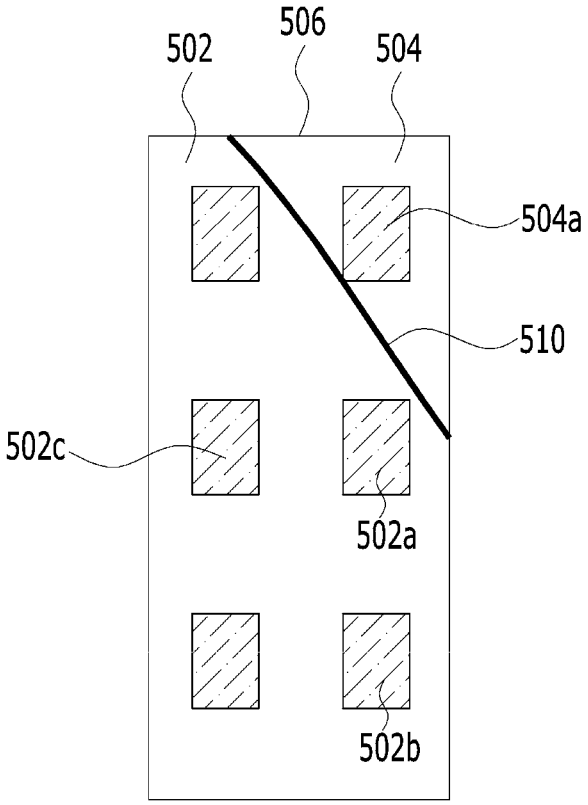
FIG. 5B illustrates a first enlarged portion of the curved area of FIG. 5A.
Figure 5B:
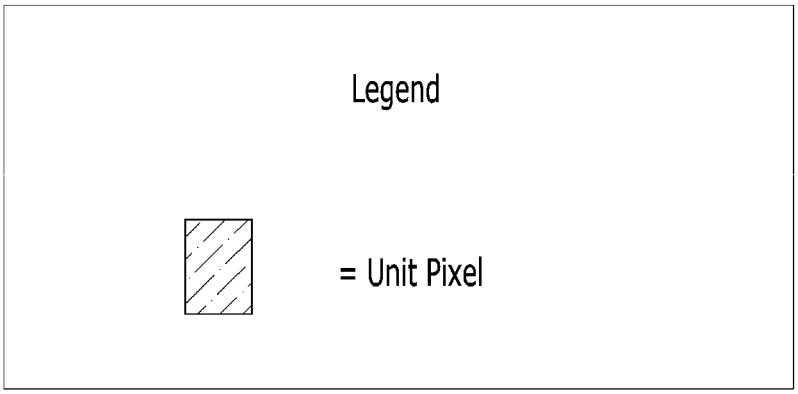
Figure 5C:
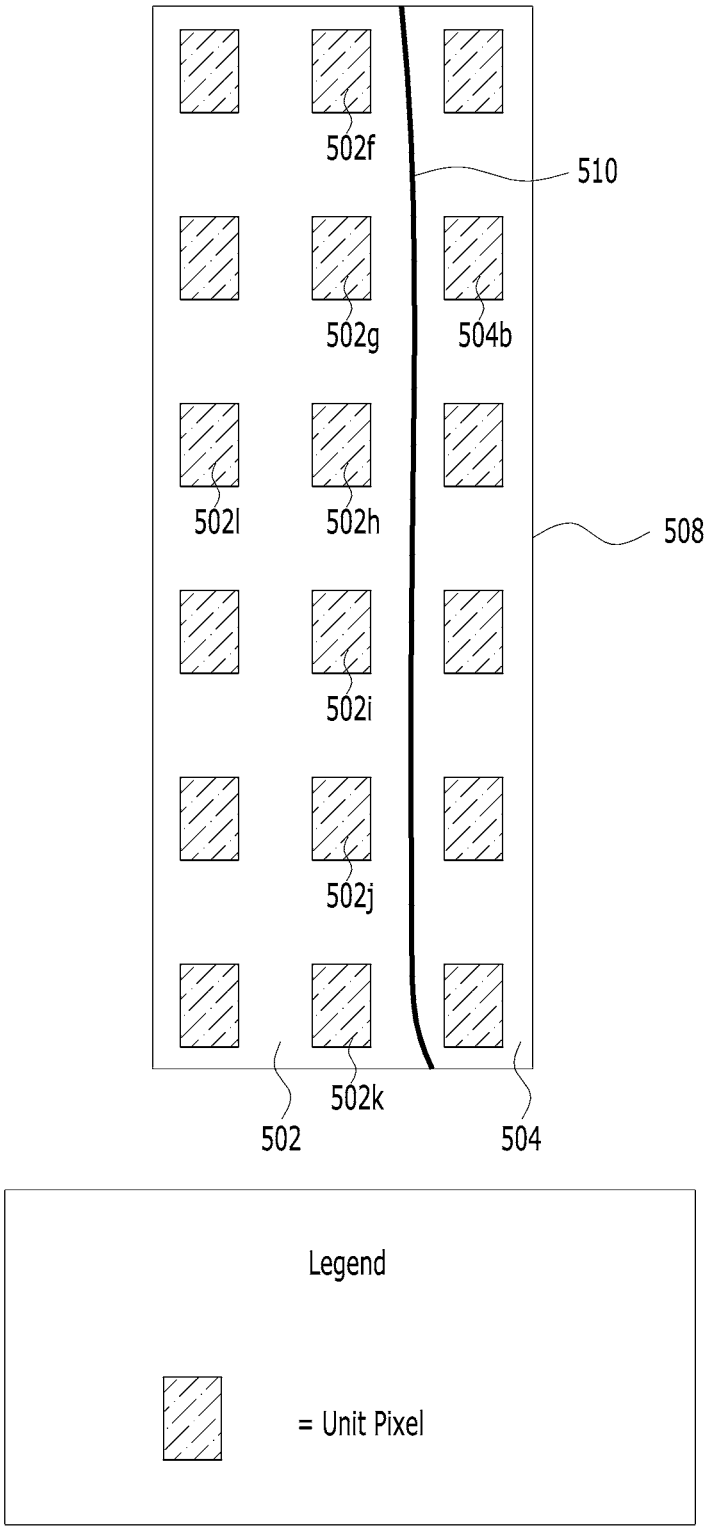
FIG. 5C illustrates a second enlarged portion of the curved area of FIG. 5A.
Figure 5D:
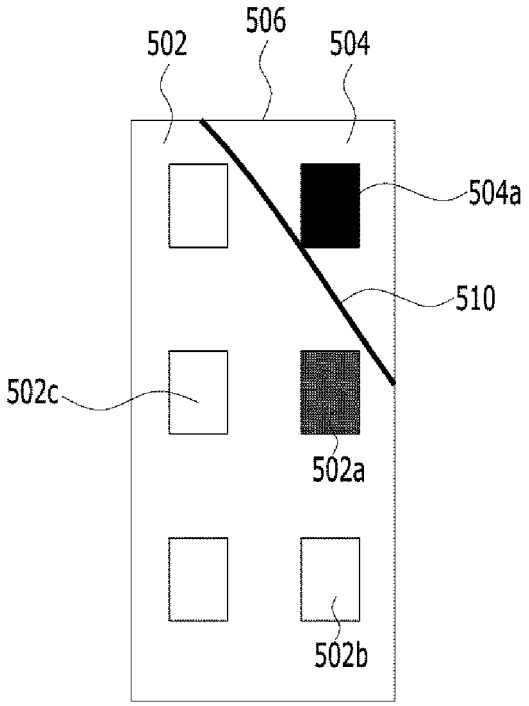
FIG. 5D illustrates the first enlarged portion of FIG. 5B in a drive state according to an exemplary embodiment.
Figure 5D:
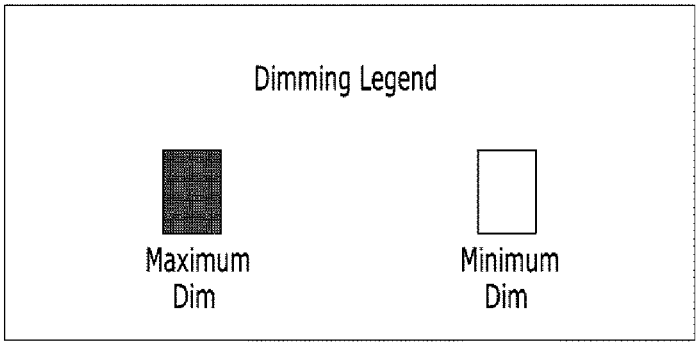
Figure 5E:
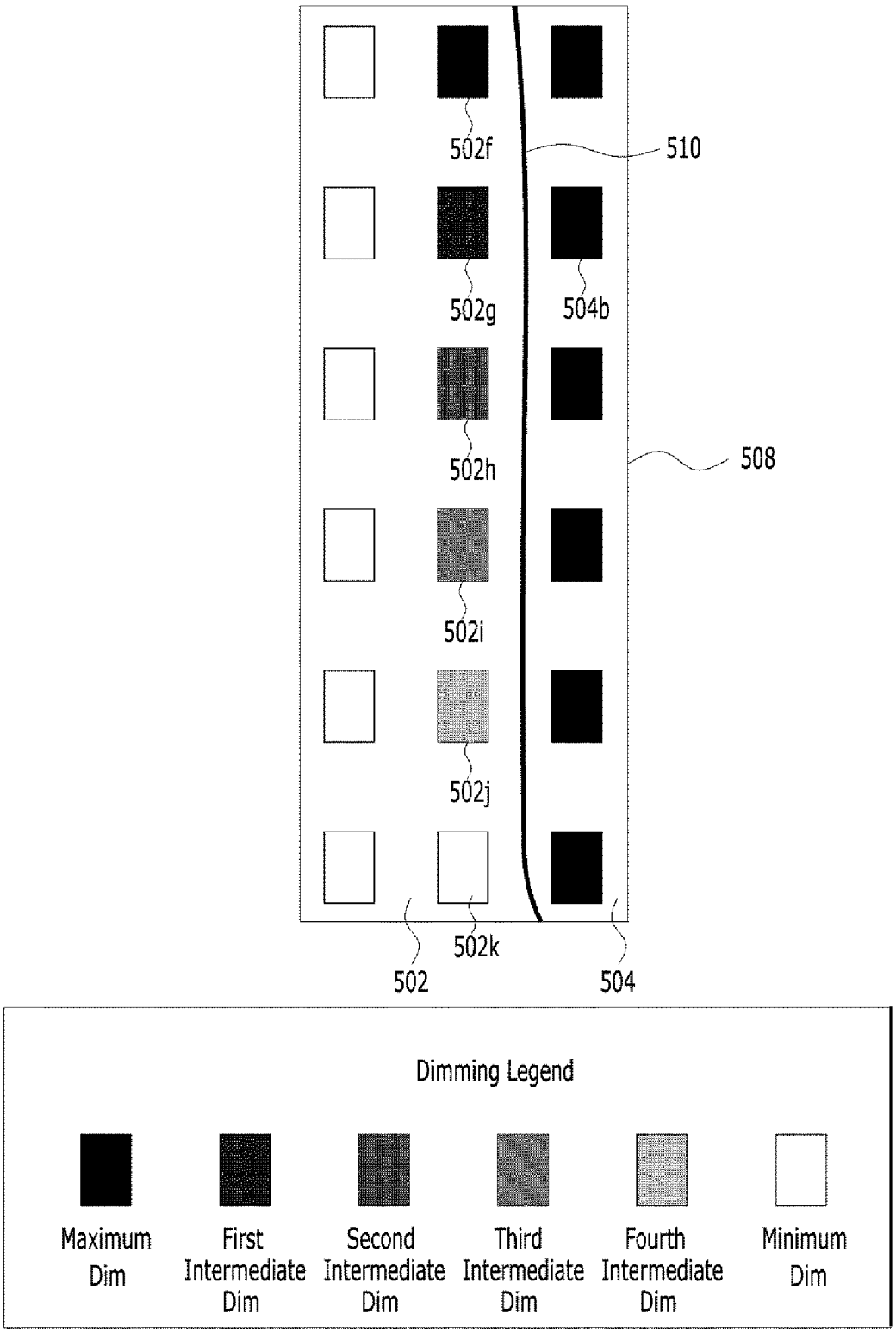
FIG. 5E illustrates the second enlarged portion of FIG. 5C in a drive state according to an exemplary embodiment.
Figure 6:
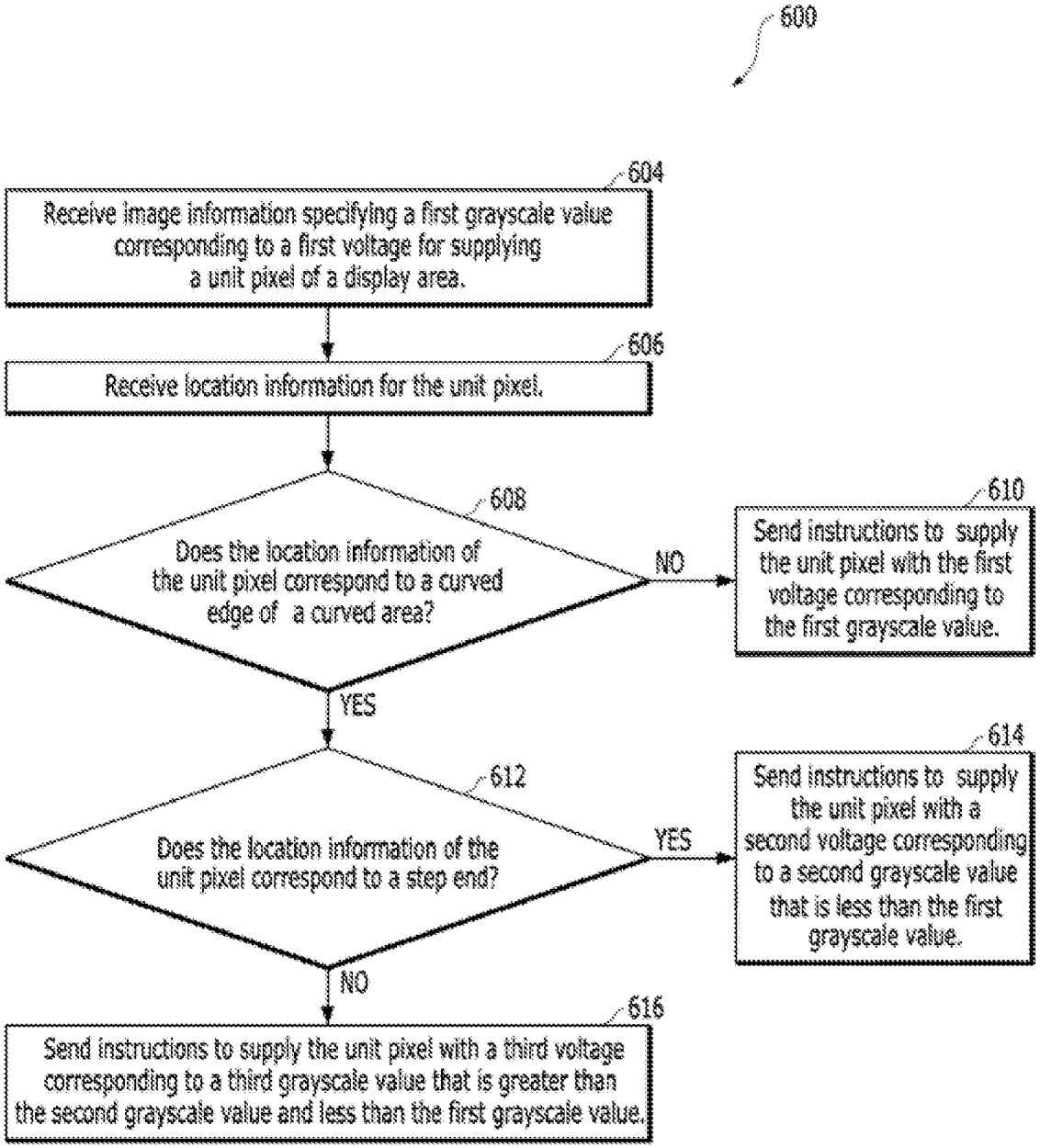
FIG. 6 is a process flow diagram illustrating an exemplary embodiment method for a signal controller to dim a unit pixel of a curved area based on a gradient.
Figure 7:
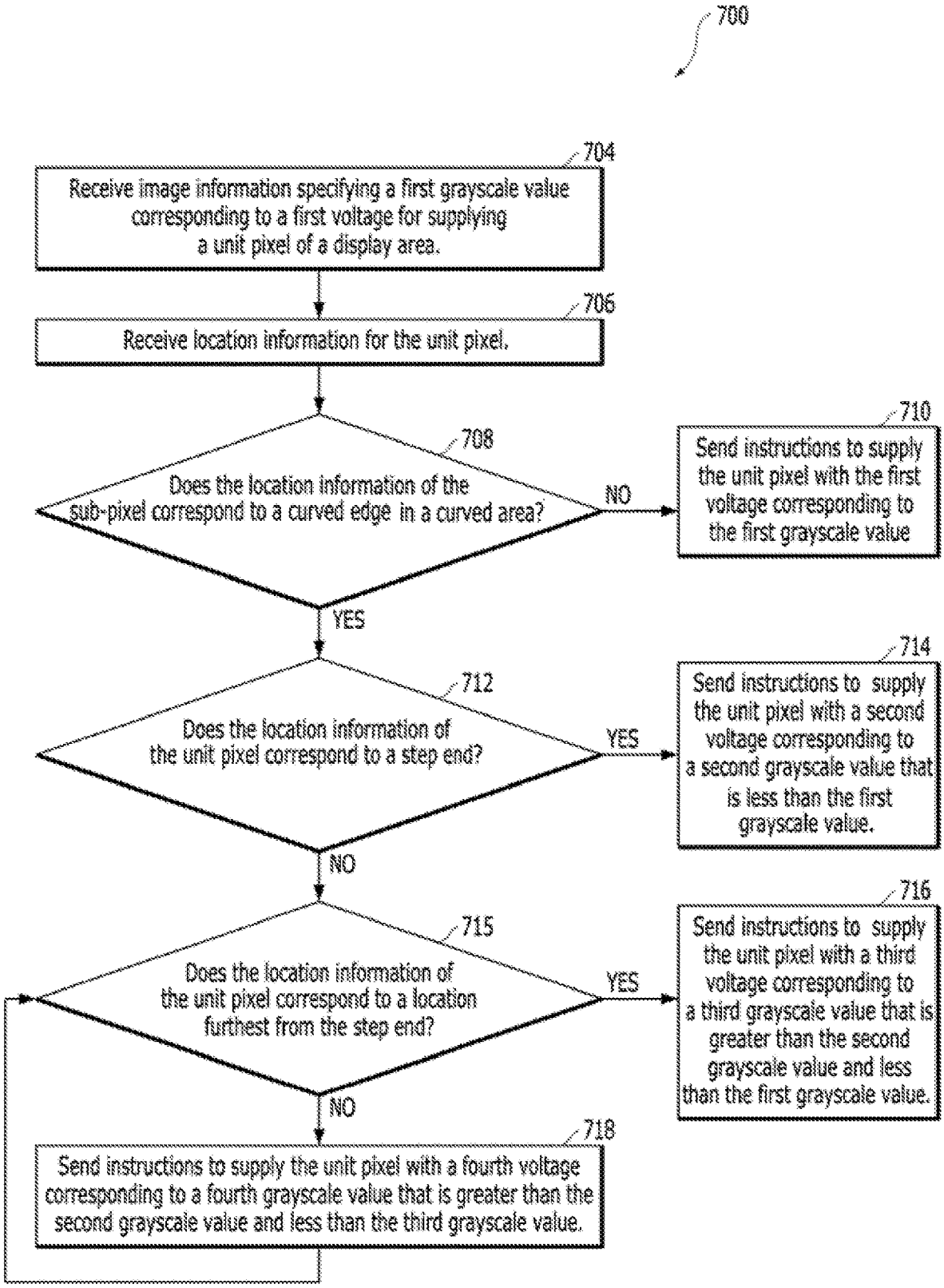
FIG. 7 is a process flow diagram illustrating an exemplary embodiment method for a signal controller to recognize a specific location of a unit pixel of a curved area and dim the unit pixel based on a gradient.

FIG. 5A illustrates a curved area of a display area of the display device of FIG. 1A according to an exemplary embodiment. FIG. 5B illustrates a first enlarged portion of the curved area of FIG. 5A. FIG. 5C illustrates a second enlarged portion of the curved area of FIG. 5A. FIG. 5D illustrates the first enlarged portion of FIG. 5B in a drive state according to an exemplary embodiment. FIG. 5E illustrates the second enlarged portion of FIG. 5C in a drive state according to an exemplary embodiment. FIG. 6 is a process flow diagram illustrating an exemplary embodiment method for a signal controller to dim a unit pixel of a curved area of a display device based on a gradient. FIG. 7 is a process flow diagram illustrating an exemplary embodiment method for a signal controller to recognize a specific location of a unit pixel of a curved area of a display device and dim a unit pixel based on a gradient rather than dim a sub-pixel based on a gradient.

FIGS. 5A, 5B, 5C, 5D, 5E, 6, and 7 are similar to FIGS. 2A, 2B, 2C, 2D, 2E, 3, and 4 except that FIGS. 5A, 5B, 5C, 5D, 5E, 6, and 7 correspond to dimming a plurality of unit pixels disposed in a column at a curved edge of a curved area 500 of a display area 502 of a display 150. For brevity, FIGS. 5A, 5B, 5C, 5D, 5E, 6, and 7 are not described in detail and as their descriptions are substantially similar to that of FIGS. 2A, 2B, 2C, 2D, 2E, 3, and 4.

Referring to FIGS. 5A, 5B, 5C, 5D, 5E, 6, and 7, a unit pixel in the display area 502 may include at least one of a red sub-pixel, a green sub-pixel, and a blue sub-pixel. Each of the plurality of unit pixels disposed in the display area 502 (e.g., unit pixels 502*a*, 502*b*, 502*c*, 502*f*, 502*g*, 502*h*, 502*i*, 502*j*, 502*k*, and 502*l*) as well as each of the unit pixels disposed in the non-display area 504 (e.g., unit pixel 504*b*) may have a polygonal shape such as a square or rectangular shape as illustrated. Although, exemplary embodiments include unit pixels having the approximate shapes and relative sizes illustrated, exemplary embodiments are not limited to unit pixels having these relative shapes and sizes. For example, a unit pixel may have any polygonal shape (e.g., a hexagonal shape, an octagonal shape, or rectangular shape) or non-polygonal shape (e.g., a circular or any other closed shape having a curved segment). As another example, a unit pixel located in the display area 502 of the display 150 may have a different size or shape a unit pixel located in the non-display area 504.

The above describe method descriptions and the process flow diagrams are provided as illustrative examples and are not intended to require or imply that the steps of the various exemplary embodiments must be performed in the order presented. Instead, the order of steps in the foregoing exemplary embodiments may be performed in any order. Words such as "after", "then," "next," etc. are merely intended to aid the reader through description of the methods.

The various illustrative logical blocks, modules, circuits, and algorithm steps described in connection with the exemplary embodiments may be implemented as electronic hardware, computer software, or combinations of both. In order to describe the interchangeability of hardware and software, various illustrative features, blocks, modules, circuits, and steps have been described above in terms of their general functionality. Whether such functionality is implemented as hardware or software depends upon the particular application and design constraints for the overall system. A person of ordinary skill in the art may implement the functionality in various ways for each particular application without departing from the scope of the present invention.

The hardware used to implement the various illustrative logics, logical blocks, modules, and circuits described in connection with the exemplary embodiments disclosed herein may be implemented or performed with a general purpose processor, a digital signal processor (DSP) an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In one or more exemplary embodiments, the functions described may be implemented in hardware, software, firmware, or any combination thereof. If implemented in software, the functions may be stored as one or more instructions or code on a non-transitory computer-readable medium or non-transitory processor-readable medium. The steps of a method or algorithm disclosed herein may be embodied in a processor-executable software module which may reside on a non-transitory processor-readable storage medium or a non-transitory computer-readable storage medium. Non-transitory computer-readable or processor-readable storage media may be any storage media that may be accessed by a computer or a processor. By way of example but not limitation, such non-transitory computer-readable or processor-readable media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disc includes optically reproducible data such as a compact disc (CD), laser disc, optical disc, digital versatile disc (DVD), and blu-ray disc. Disk includes magnetically reproducible data such as a floppy disk. Combinations of the above are also included within the scope of non-transitory computer-readable and processor-readable media. Additionally, the operations of a method or algorithm may reside as one or any combination or set of codes and/or instructions on a non-transitory processor-readable medium and/or computer-readable medium, which may be incorporated into a computer program product.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device, comprising:

an organic light emitting diode (OLED) display panel having a display area comprising a first pixel, a second pixel disposed along a curved edge of the display area, and a third pixel not corresponding to the curved edge;

a non-display area having a curved boundary that corresponds to the curved edge of the display area, wherein the non-display area comprises a dummy pixel that is ordinarily off while other pixels are turned on; and a processor configured to:

receive a grayscale value corresponding to an intended voltage for each pixel of the display panel to have an intended brightness;

drive the first pixel with a first voltage less than the intended voltage of the first pixel to have a first brightness less than the intended brightness of the first pixel;

drive the second pixel with a second voltage less than the intended voltage of the second pixel to have a second brightness that is brighter than the first brightness and less than the intended brightness of the second pixel;

drive the third pixel with a third voltage less than or equal to the intended voltage of the third pixel to have a third brightness less than or equal to the intended brightness of the third pixel that is brighter than the second brightness; and turn on the dummy sub-pixel to correct a color at the curved edge of the display area.

2. The display device of claim 1, wherein the display area further comprises a fourth pixel corresponding to the curved edge and wherein the processor is configured to drive the fourth pixel with a fourth voltage less than the intended voltage of the fouth pixel to have a fourth brightness that is brighter than the first brightness, less than the second brightness, and less than the intended brightness of the fourth pixel.

3. The display device of claim 2, wherein the curved edge comprises the first pixel, the second pixel, and the fourth pixel arranged in a column.

4. The display device of claim 3, wherein each of the first pixel, second pixel, third pixel, fourth pixel, and the dummy pixel is at least one of a red sub-pixel, a green sub-pixel, or a blue sub-pixel.

5. The display device of claim 1, wherein each of the first pixel, the second pixel, the third pixel, the fourth pixel, and the dummy pixel is a unit pixel comprising a red sub-pixel, a green sub-pixel, and a blue sub-pixel.

6. The display device of claim 1, wherein each of the first pixel, the second pixel, the third pixel, the fourth pixel, and the dummy pixel is a unit pixel comprising:

a red sub-pixel and a green sub-pixel, or a blue sub-pixel and the green sub-pixel.

7. A method of displaying an image on an organic light emitting diode (OLED) display device, comprising:

receiving, by a processor of the OLED display device, a grayscale value corresponding to an intended voltage for each pixel of the OLED display device to have an intended brightness;

sending, by the processor of the OLED display device, instructions to a data driver to supply a pixel with a first voltage equal to the intended voltage corresponding to a first grayscale value when the processor determines that location information of a pixel does not correspond to a curved edge in a curved area of a display area of the display device;

sending, by the processor, instructions to the data driver to supply the pixel with a second voltage less than the intended voltage corresponding to a second grayscale value that is less than the first grayscale value when the processor determines that the location information of the pixel corresponds to a step end of the curved edge;

sending, by the processor, instructions to the data driver to supply the pixel with a third voltage less than the intended voltage and greater than the second voltage corresponding to a third grayscale value that is greater than the second grayscale value and less than the first grayscale value when the processor determines that the location information of the pixel does not correspond to the step end of the curved edge; and sending, by the processor, instructions to turn on a dummy pixel that is ordinarily off while other pixels are turned on in order to correct a color at the curved edge of the display area, the dummy pixel disposed in a non-display area having a curved boundary that corresponds to the curved edge of the display device.

8. The method of claim 7, wherein the method further comprises:

receiving, by the processor, image information specifying the first grayscale value corresponding to the first voltage for supplying the pixel in the display area of the display device;

receiving, by the processor, the location information for the pixel;

determining, by the processor, whether the location information of the pixel corresponds to the curved edge in the curved area of the display area;

determining, by the processor, whether the location information of the pixel corresponds to the step end of the curved edge when the processor determines that the location information of the pixel corresponds to the curved edge in the curved area; and determining, by the processor, whether the location information of the pixel corresponds to a location furthest from the step end;

sending, by the processor, instructions to the data driver to supply the pixel with the third voltage corresponding to the third grayscale value that is less than the first grayscale value and greater than the second grayscale value when the processor determines that the location information of the pixel corresponds to the location furthest from the step end; and sending, by the processor, instructions to the data driver to supply the pixel with a fourth voltage less than the intended voltage, less than the third voltage, and greater than the second voltage corresponding to a fourth grayscale value that is greater than the second grayscale value and less than the third grayscale value.

9. The method of claim 8, wherein each of the pixel in the display area and the dummy pixel is at least one of a red sub-pixel, a green sub-pixel, or a blue sub-pixel.

10. The method of claim 8, wherein each of the pixel in the display area and the dummy pixel is a unit pixel comprising at least one of a red sub-pixel, a green sub-pixel, and a blue sub-pixel.

11. The method of claim 8, wherein:

the first grayscale value corresponds to a maximum brightness for display in the display area, and the second grayscale value corresponds to a minimum brightness for display in the display area.

12. The method of claim 11, wherein:

the third grayscale value corresponds to a first intermediate brightness that is less than the maximum brightness but greater than the minimum brightness, and the fourth grayscale value corresponds to a second intermediate brightness that is greater than the minimum brightness but less than the first intermediate brightness.

13. A driving device, comprising: a processor configured to:

receive a grayscale value corresponding to an intended voltage for each pixel of an organic light emitting diode (OLED) display device to have an intended brightness;

drive a first pixel in a display area of the OLED display device with a first voltage less than the intended voltage of the first pixel to have a first brightness less than the intended brightness of the first pixel;

drive a second pixel in the display area with a second voltage less than the intended voltage of the second pixel to have a second brightness that is brighter than the first brightness and less than the intended brightness of the second pixel; and turn on a dummy pixel that is ordinarily off while other pixels are turned on in order to correct a color at the curved edge of the display area, the dummy pixel disposed in a non-display area having a curved boundary that corresponds to the curved edge of the display device, wherein the first pixel and the second pixel are disposed in a straight line along a curved edge of the display area.

14. The driving device of claim 13, wherein the processor is further configured to:

drive a third pixel disposed inside of the curved edge of the display area with a third voltage equal to the intended voltage of the third pixel to have a third brightness that is brighter than the second brightness and equal to the intended brightness of the third pixel, and drive a fourth pixel disposed in the straight line along the curved edge of the display area with a fourth voltage less than the intended voltage of the fourth pixel to have a fourth brightness that is brighter than the first brightness and less than the second brightness.

15. The driving device of claim 14, wherein each of the first pixel, the second pixel, the third pixel, and the fourth pixel comprises at least one of a red sub-pixel, a green sub-pixel, or a blue sub-pixel.

16. The driving device of claim 14, wherein each of the first pixel, the second pixel, the third pixel, and the fourth pixel is a unit pixel comprising at least one of a red sub-pixel, a green sub-pixel, and a blue sub-pixel.

17. A display device, comprising:

an organic light emitting diode (OLED) display panel having a display area comprising:

a first pixel and a second pixel disposed in a straight line along a curved edge of the display area: and a third pixel not corresponding to the curved edge;

a non-display area having a curved boundary corresponding to the curved edge of the display area, the non-display area comprising a dummy pixel that is ordinarily off while other pixels are turned on; and a signal controller to control voltage of the first, second, third, and dummy pixels, wherein the first pixel is disposed at a step end of the straight line and receives a first voltage less than an intended voltage of the first pixel to have a first brightness less than an intended brightness of the first pixel, the second pixel is disposed furthest from the step end receives a second voltage less than an intended voltage of the second pixel to have a second brightness that is brighter than the first brightness and less than an intended brightness of the second pixel, the third pixel receives an intended voltage of the third pixel has a third brightness that is brighter than the second brightness and equal to an intended brightness of the third pixel, and the dummy pixel is selectively turned on in order to correct a color at the curved edge of the display area.

18. The display device of claim 17, wherein the display area further comprises a fourth pixel corresponding to the curved edge and disposed between the first pixel and the second pixel, the fourth pixel receives a fourth voltage less than an intended voltage of the fourth pixel to have a fourth brightness that is less than the intended brightness of the fourth pixel, brighter than the first brightness, and less than the second brightness.

19. The display device of claim 18, wherein the curved edge comprises the first pixel, the second pixel, and the fourth pixel arranged in a column.

20. The display device of claim 18, wherein each of the first pixel, second pixel, third pixel, and the fourth pixel, is at least one of a red sub-pixel, a green sub-pixel, or a blue sub-pixel.

21. The display device of claim 18, wherein each of the first pixel, the second pixel, the third pixel, and the fourth pixel, is a unit pixel comprising a red sub-pixel, a green sub-pixel, and a blue sub-pixel.

* * * * *